US010120312B2

(12) United States Patent
Uchida et al.

(10) Patent No.: US 10,120,312 B2
(45) Date of Patent: Nov. 6, 2018

(54) IMAGE FORMING APPARATUS, IMAGE FORMING SYSTEM, METHOD OF CONTROLLING IMAGE FORMING APPARATUS, AND RECORDING MEDIUM

(71) Applicants: Takeshi Uchida, Kanagawa (JP); Takuma Higa, Kanagawa (JP); Shinya Kamijo, Tokyo (JP); Takeshi Takahashi, Kanagawa (JP)

(72) Inventors: Takeshi Uchida, Kanagawa (JP); Takuma Higa, Kanagawa (JP); Shinya Kamijo, Tokyo (JP); Takeshi Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/493,656

(22) Filed: Apr. 21, 2017

(65) Prior Publication Data

US 2018/0095390 A1 Apr. 5, 2018

(30) Foreign Application Priority Data

Oct. 5, 2016 (JP) ..... 2016-197633

(51) Int. Cl.
*G03G 15/00* (2006.01)
*G03G 15/08* (2006.01)
*G03G 15/06* (2006.01)

(52) U.S. Cl.
CPC ..... *G03G 15/50* (2013.01); *G03G 15/065* (2013.01); *G03G 15/08* (2013.01); *G03G 15/5004* (2013.01)

(58) Field of Classification Search
CPC ..... G03G 15/06; G03G 15/065; G03G 15/50; G03G 15/5004
(Continued)

(56) References Cited

U.S. PATENT DOCUMENTS 5,826,144 A * 10/1998 Takenaka ..... G03G 15/0808 399/222
2008/0292379 A1 11/2008 Tsuchiya
(Continued)

FOREIGN PATENT DOCUMENTS

EP 2 116 907 A1 11/2009
JP 2006-292644 12/2006

OTHER PUBLICATIONS

Extended European Search Report dated Nov. 2, 2017 in Patent Application No. 17167517.6.

*Primary Examiner* — Benjamin Schmitt
(74) *Attorney, Agent, or Firm* — Oblon, McClelland, Maier & Neustadt, L.L.P.

(57) ABSTRACT

An image forming apparatus includes an image forming device to form a toner image onto a recording medium by transferring the toner image directly or indirectly onto the recording medium, the image forming device including a developer to develop a latent image formed on an image carrier into the toner image; and a controller to control the image forming device. The controller determines whether a first estimated time period is greater than a first predetermined time period, the first estimated time period being a time period from a time when image formation of one page of the image completes to an estimated time when image formation of a subsequent page of the image will start; and stops operating the developer based on a determination indicating that the first estimated time period is greater than the first predetermined time period.

9 Claims, 22 Drawing Sheets

(58) Field of Classification Search
USPC ..... 399/43, 53, 76, 222, 270
See application file for complete search history.

(56) References Cited

U.S. PATENT DOCUMENTS

| | | | | |
|---|---|---|---|---|
| 2009/0279910 | A1* | 11/2009 | Shiori | G03G 15/50 399/50 |
| 2010/0124427 | A1 | 5/2010 | Sugiyama | |
| 2012/0033985 | A1 | 2/2012 | Sugiyama | |
| 2012/0155892 | A1 | 6/2012 | Ishida | |
| 2015/0261122 | A1* | 9/2015 | Hayashi | G03G 15/065 399/55 |
| 2015/0277279 | A1 | 10/2015 | Suzuki | |

* cited by examiner

IMAGE FORMING APPARATUS, IMAGE FORMING SYSTEM, METHOD OF CONTROLLING IMAGE FORMING APPARATUS, AND RECORDING MEDIUM

CROSS-REFERENCE TO RELATED APPLICATIONS

This patent application is based on and claims priority pursuant to 35 U.S.C. § 119(a) to Japanese Patent Application No. 2016-197633, filed on Oct. 5, 2016, in the Japan Patent Office, the entire disclosure of which is hereby incorporated by reference herein.

BACKGROUND

Field of the Invention

The present invention relates to an image forming apparatus, an image forming system, a method of controlling an image forming apparatus, and a non-transitory recording medium.

Description of the Related Art

In an image forming apparatus of the related art, an electrostatic latent image on a photoconductor, which is an image bearer, is developed by a developer such as a toner, and is transferred onto a recording medium, to form an image on the recording medium. Such transfer may be directly performed with respect to a sheet such as a paper. Alternatively, an image which is primarily transferred onto an intermediate transfer belt may be secondarily transferred onto a sheet such as a paper.

SUMMARY

Example embodiments of the present invention include an image forming apparatus, which includes: an image forming device to form a toner image onto a recording medium by transferring the toner image directly or indirectly onto the recording medium, the image forming device including a developing unit to develop a latent image formed on an image carrier into the toner image; and a controller to control the image forming device. The controller is to determine whether a first estimated time period is greater than a first predetermined time period, the first estimated time period being a time period from a time when image formation of one page of the image completes to an estimated time when image formation of a subsequent page of the image will start; stop operating the developing unit based on a determination indicating that the first estimated time period is greater than the first predetermined time period; determine, after determination of a time when image formation of the subsequent page of the image starts, whether an updated first estimated time period reflecting the determined time when image formation of the subsequent page of the image starts, is equal to or less than the first predetermined time period; and start operating the developing unit based on a determination indicating that the updated first estimated time period is equal to or less than the first predetermined time period.

Example embodiments of the present invention include a method of controlling the image forming apparatus performed by a controller, and a recording medium storing a control program.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
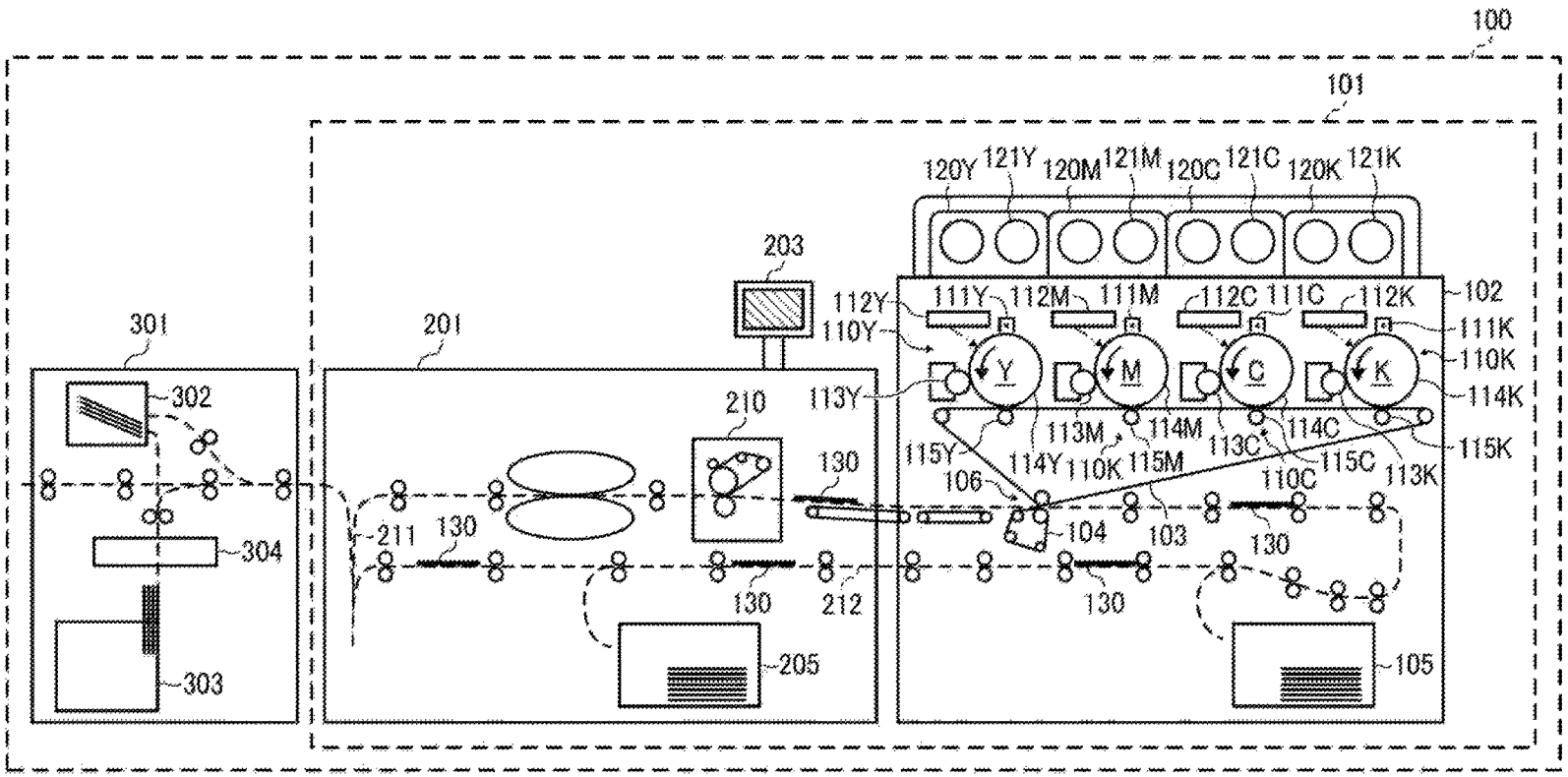
FIG. 1 is a schematic cross-sectional view illustrating a configuration of an image forming system including an image forming apparatus according to a first embodiment of the present invention.

The accompanying drawings are intended to depict embodiments of the present invention and should not be interpreted to limit the scope thereof. The accompanying drawings are not to be considered as drawn to scale unless explicitly noted.

DETAILED DESCRIPTION OF THE INVENTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

First Embodiment: FIG. 1 to FIG. 10

Hereinafter, embodiments of the present invention will be described with reference to the drawings.

FIG. 1 illustrates a schematic configuration of an image forming system including an image forming apparatus according to a first embodiment of the present invention. FIG. 1 is a schematic cross-sectional view illustrating the configuration of a portion of the image forming system, which is involved with image formation, fixing, and post processing with respect to a sheet.

An image forming system 100 illustrated in FIG. 1 includes an image forming apparatus 101 and a post processing apparatus 301.

The image forming apparatus 101 includes an image forming device 102 and a fixing device 201.

The image forming device 102 prints an image. More particularly, the image forming device 102 forms a toner image on a recording paper 130 which is a sheet-like recording medium based on image data. The fixing device 201 applies heat and pressure to the toner image formed by the image forming device 102, and fixes the toner image to the recording paper 130.

The image forming device 102 includes an intermediate transfer belt 103 at its center portion. In the image forming device 102, image forming units 110 for forming toner images of respective colors of yellow, magenta, cyan, and black (hereinafter, respectively referred to as Y, M, C, and K) on the intermediate transfer belt 103, are arranged side by side to face the intermediate transfer belt 103.

Each of the image forming units 110 includes a charging unit 111, an exposure unit 112, a developing unit 113, and a photoconductor drum 114. In the drawing, an alphabet representing the color of an image to be formed, such as "110Y", is applied to the suffix of the reference numeral representing each of the units, but a reference numeral without an alphabet will be used to describe the configuration common to all of the colors.

The photoconductor drum 114 is an image bearer for bearing an image formed by the image forming unit 110. The charging unit 111 is disposed near a circumferential surface of the photoconductor drum 114, and evenly charges the photoconductor drum 114. The exposure unit 112 includes a light source which is subjected to ON/OFF control according to the image data. The exposure unit 112 scans the photoconductor drum 114 with light exiting from the light source, and forms an electrostatic latent image of the image represented by the image data on the photoconductor drum 114. The developing unit 113 develops the electrostatic latent image by using a toner which is a developer. The toner used for developing is stored in a toner bottle 121, and supplied from a toner supply unit 120.

The toner images of the respective colors, which are formed by the image forming units 110, are primarily transferred by being superimposed on the intermediate transfer belt 103 one above the other by transfer rollers 115Y to 115K corresponding to the respective colors.

The image forming device 102 and the fixing device 201 respectively include paper feeding devices 105 and 205, in which the recording paper 130 is stored. The recording paper 130 is conveyed through a conveyance path illustrated by a broken line by a conveyance roller at a nip 106 between the intermediate transfer belt 103 and the secondary transfer belt 104, at a timing such that the toner image on the intermediate transfer belt 103 is secondarily transferred onto the recording paper 130 at the nip 106.

The image forming device 102 conveys the recording paper 130 having the toner image thereon to a fixing unit 210 of the fixing device 201. The fixing unit 210 applies heat and pressure to the recording paper 130, such that the toner image on the recording paper 130 melts to be fixed onto the recording paper 130. After that, the fixing device 201 conveys the recording paper 130 to the post processing apparatus 301. In the case of duplex printing, the fixing device 201 returns the recording paper 130 in which the image is fixed onto a first surface to the image forming device 102 through a paper reverse path 211 and a duplex conveyance path 212, and forms an image on a second surface in the same procedure as that of the first surface.

The fixing device 201 further includes a display device 203, which displays the state or the like of the image forming apparatus 101.

The post processing apparatus 301 performs post processing such as punching, stapling, and binding, with respect to the recording paper 130 which has been printed (to which the image has been fixed). In the case of performing the post processing, the recording paper 130 which has been printed is integrated with the integration unit 302, and the recording paper 130 of the number of units performing the post processing is aligned, and then, the recording paper 130 is conveyed to a post processing unit 304, and the post processing is performed. The recording paper 130 after the post processing is discharged and loaded onto a loading portion 303. In the case of not performing the post processing, the recording paper 130 which has been printed is directly discharged to a right side and a left side of the drawing.

Figure 2:
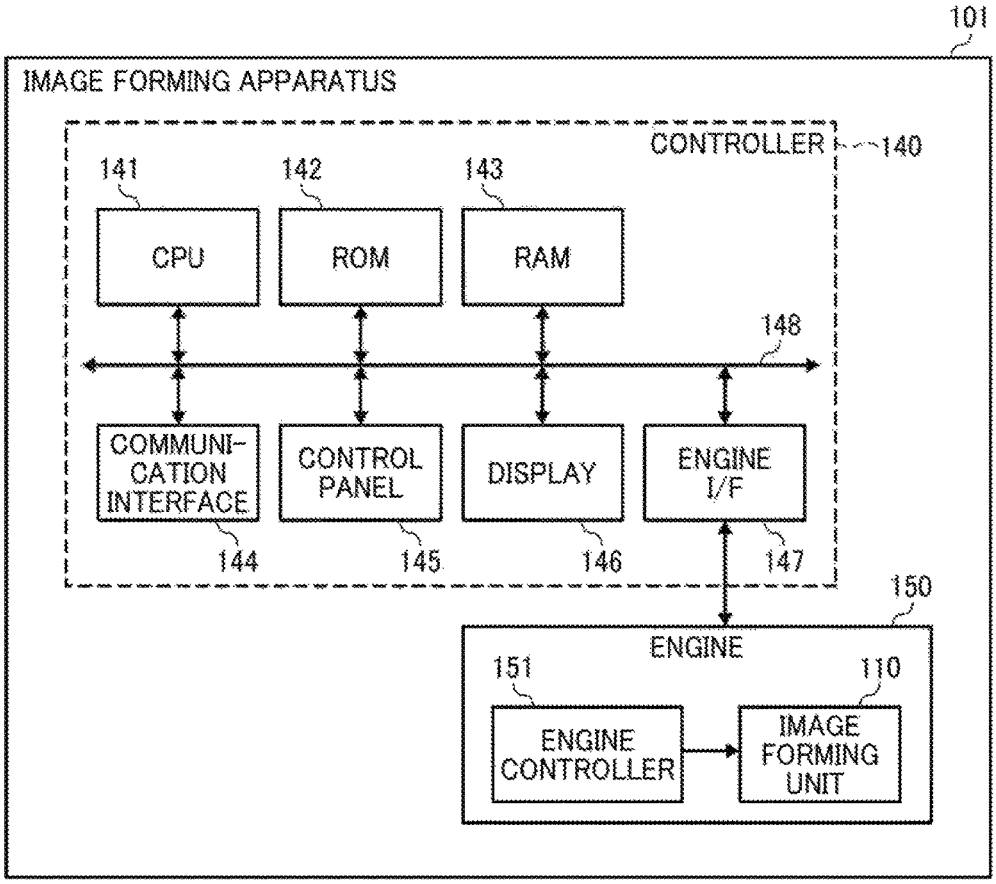
FIG. 2 is a diagram illustrating a hardware configuration of a controller controlling the image forming apparatus illustrated in FIG. 1.

Next, FIG. 2 illustrates a hardware configuration of a controller controlling the image forming apparatus 101 described above.

As illustrated in FIG. 2, a controller 140 of the image forming apparatus 101 includes a central processing unit (CPU) 141, a read-only memory (ROM) 142, a random access memory (RAM) 143, a communication interface 144, a control panel 145, a display 146, and an engine interface (I/F) 147, and such units are coupled to each other by a system bus 148.

The CPU 141 executes a program stored in the ROM 142 by using the RAM 143 as a work area, and thus, controls the entire image forming apparatus 101. For example, the CPU 141 executes various functions illustrated in FIG. 3 in the image forming apparatus 101.

The ROM 142 is a non-volatile storage medium (a storage unit), and stores various data items required for various programs or processing executed by the CPU 141.

The communication interface 144 is an interface for communicating with the post processing apparatus 301 or other devices such as a print control device 401 described below. The communication may be performed by a leased line, or may be performed through a public network, and an arbitrary protocol can be adopted regardless of wired or wireless.

The control panel 145 is a control panel for receiving an operation from a user, and is implemented by various keys, buttons, touch panels, and the like.

The display 146 is a presentation unit for presenting an operation state or setting contents of the image forming apparatus 101, a message, or the like to the user, such as the display device 203 illustrated in FIG. 1, and includes a liquid crystal display, a lamp, or the like.

The engine I/F 147 is an interface which couples an engine 150 to the system bus 148, and can be controlled from the CPU 141.

The engine 150 corresponds to hardware executing image formation and image fixing with respect to a sheet, illustrated in FIG. 1. FIG. 2 illustrates an engine controller 151 and the image forming unit 110 illustrated in FIG. 1. The engine controller 151 is a controller controlling the operation of the engine 150 including the image forming unit 110, according to a control signal supplied from the CPU 141 through the engine I/F 147, and for example, includes a microcomputer.

In the image forming system 100 described above, control relevant to the stop and the restart of the operation of the developing unit 113 of the image forming apparatus 101 will be described in detail.

Figure 3:
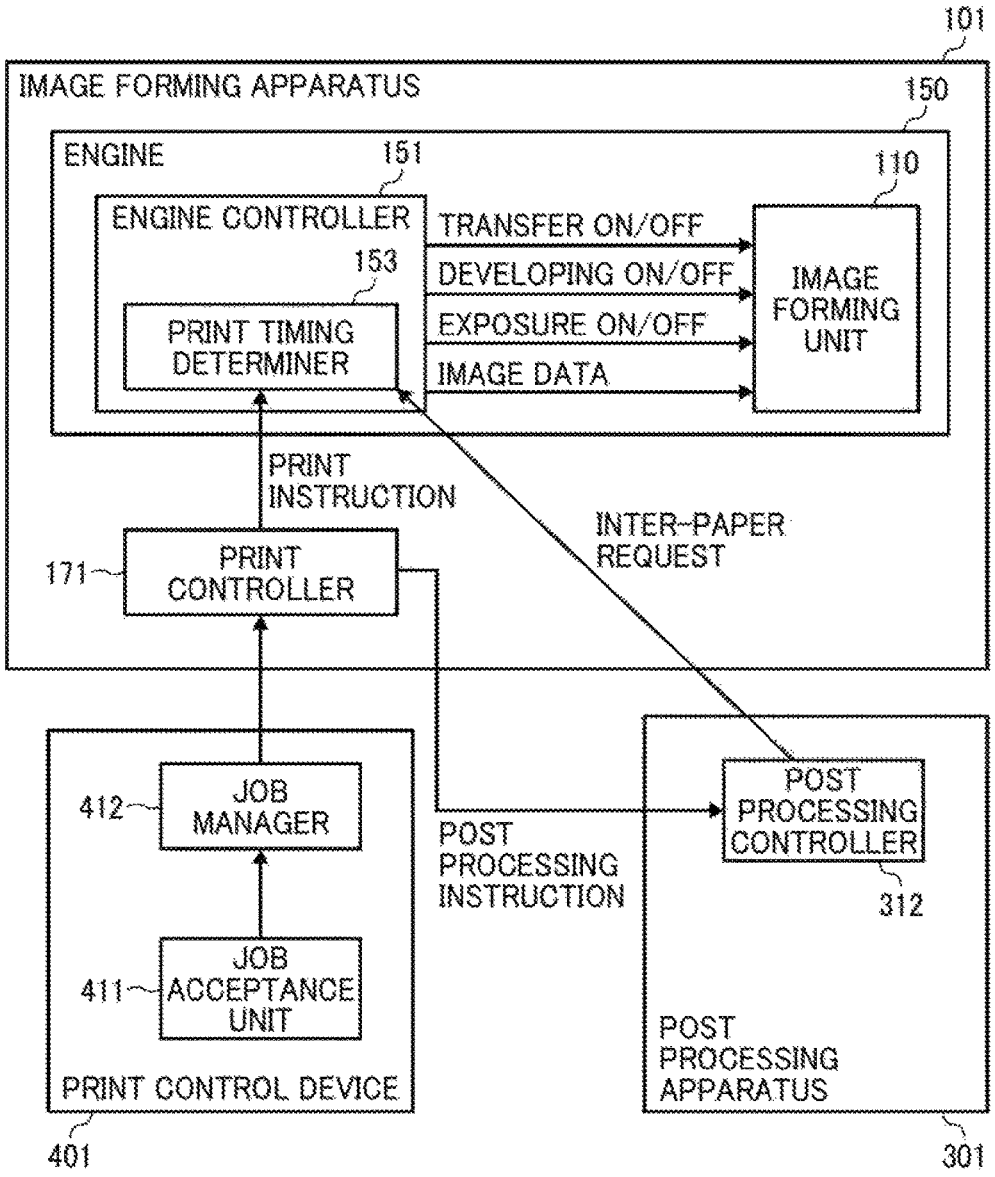
FIG. 3 is a diagram illustrating a schematic configuration of a function relevant to timing control of print including stop and restart of an operation of a developing unit provided in the image forming apparatus illustrated in FIG. 1 and a peripheral device thereof.

First, FIG. 3 illustrates a diagram illustrating a schematic configuration of a function relevant to timing control of print including the stop and the restart of the operation of the developing unit 113 provided in the image forming apparatus 101 and a peripheral device thereof.

As illustrated in FIG. 3, the image forming apparatus 101 is coupled to the post processing apparatus 301 and the print control device 401 to communicate with each other, through a predetermined communication path.

The post processing apparatus 301 is a device configuring the image forming system 100 along with the image forming apparatus 101.

The print control device 401 is a device receiving the designation of a print job and an execution instruction thereof executed in the image forming system 100 from the user. Information required for the image forming apparatus 101 and the post processing apparatus 301 is transmitted according to the instruction, and the print job is executed. Here, the information to be transmitted, for example, print setting information such as image data of an image to be printed, paper used for print, the number of print copies, the presence or absence of duplex printing, and the presence or absence of the post processing, and the execution instruction of a job.

A job acceptance unit 411 has a function of receiving the designation of the job and the execution instruction, and a job manager 412 has a function of managing the execution of the job.

The image forming apparatus 101 includes a print controller 171 of which the function is realized by the CPU 141, and the print controller 171 has a function of controlling the operation of the entire image forming apparatus 101 including the engine 150. The print controller 171 instructs the engine 150 to perform print according to the image data and the print setting information received from the print control device 401, or instructs a post processing controller 312 of the post processing apparatus 301 to perform the post processing according to the print setting information.

The engine 150 includes the engine controller 151. The engine controller 151 controls the image forming unit 110, the fixing unit 210, the conveyance roller, and the like according to a print instruction from the print controller 171, and operates the image forming unit 110, the fixing unit 210, the conveyance roller, and the like at proper timing, and thus, executes the print according to the print instruction. FIG. 3 illustrates the image forming unit 110 as an example of a control target.

The engine controller 151 supplies signals of controlling ON/OFF of the operations of each of the units or image data of an image to be printed to the image forming unit 110, and controls the operation of the image forming unit 110. The control is individually performed with respect to the image forming units 110 of the respective colors.

Among the signals illustrated in FIG. 3, "transfer ON/OFF" is a transfer signal for instructing ON/OFF of a nip between the transfer roller 115 and the photoconductor drum 114. The engine controller 151 turns on the signal only during a period in which the toner image on the photoconductor drum 114 faces the intermediate transfer belt 103, and executes the transfer roller 115 to primarily transfer the toner image onto the intermediate transfer belt 103.

"Developing ON/OFF" is a developing signal for instructing ON/OFF of the operation of the developing unit 113, and the engine controller 151 changes ON/OFF at timing described in detail by using FIG. 5 to FIG. 8. In the case of ON, the developing unit 113 supplies the developer by being in contact with the photoconductor drum 114, and performs an operation of developing the electrostatic latent image on the photoconductor drum 114. In the case of OFF, the developing unit 113 stops the operation by being separated from the photoconductor drum 114, and does not supply the developer onto the photoconductor drum 114. In order to mix the developer with a carrier, the developing unit 113 also performs an operation of stirring the developer and the carrier. In an operation stop state, the stirring may be stopped, but it is not essential to stop the stirring, and it is sufficient to stop the supply of the developer at least onto the photoconductor drum 114.

"Exposure ON/OFF" is an exposure signal for instructing lighting ON/OFF of the light source of the exposure unit 112. In the case of OFF, the light source is coercively turned off, and in the case of ON, ON/OFF of the light source is controlled according to a synchronization signal, image data, or the like, and the electrostatic latent image is written on the photoconductor drum 114. The engine controller 151 turns on the signal only during a period in which the electrostatic latent image is written on the photoconductor drum 114.

The engine controller 151 includes a print timing determiner 153. The print timing determiner 153 determines timing of printing each of the pages according to the print instruction of the print controller 171, such as an inter-paper request from the post processing controller 312 described below. The engine controller 151 transmits various signals or image data items described above to each of the units including the image forming unit 110 such that the print is executed according to the determined timing.

The post processing apparatus 301 includes the post processing controller 312. The post processing controller 312 has a function of controlling the integration unit 302, the post processing unit 304, and the like, and of performing the post processing with respect to the recording paper 130 to which an image is fixed in the fixing device 201 of the image forming apparatus 101. The post processing requires a certain period of time including paper conveyance, and thus, the recording paper 130 of the number of units performing the post processing is aligned in the integration unit 302, and then, an interval is provided to the next paper.

The post processing controller 312 has a function of transmitting the inter-paper request, which requests the adjustment of the print timing such that an interval is provided between the papers by a time required for the post processing in a portion in which the post processing is performed, with respect to the print timing determiner 153 of the image forming apparatus 101. In a case where the print timing determiner 153 receives the inter-paper request, the timing of printing each of the pages is determined such that the print of the next page of the requested portion is maximally delayed as the requested interval can be ensured.

Figure 4:
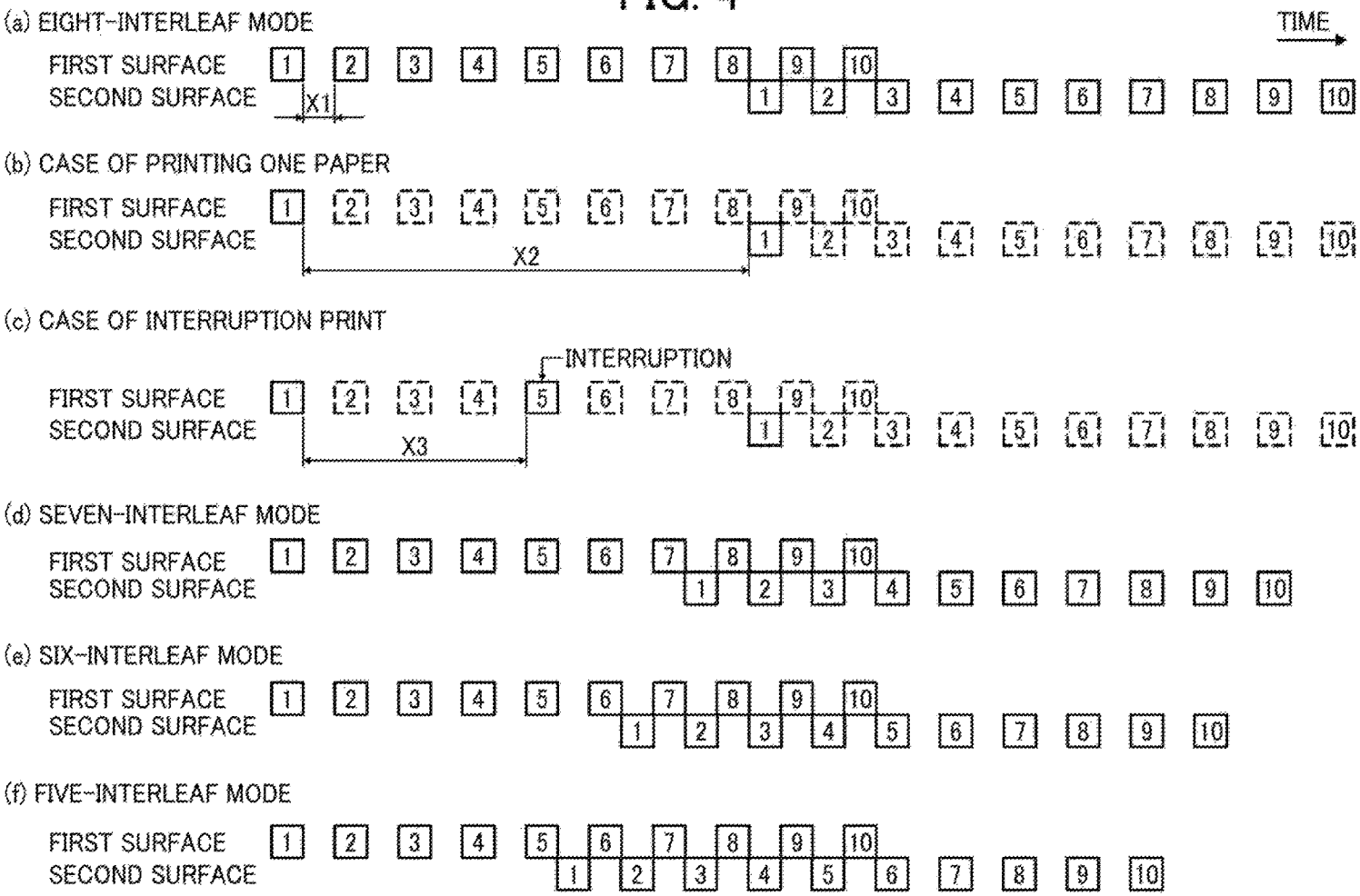
FIG. 4 is a diagram illustrating an example of print timing of each page in the image forming apparatus illustrated in FIG. 1.

Next, FIG. 4 illustrates an example of the print timing of each of the pages of the image forming apparatus 101. In FIG. 4, a lateral direction represents a time axis, and a rectangle represents a period in which the print of one page is performed. Here, a print period is displayed on the basis of a period in which an image of one color is primarily transferred, and the primarily transferred image is moved at a constant linear velocity and is provided for the secondary transfer to the recording paper 130, and thus, the length or a relative positional relationship of each period is not changed even considering the secondary transfer as a reference. A number in the rectangle represents which print of the paper of each surface. FIG. 4 illustrates print timing in the case of respectively printing on both surfaces of ten recording papers 130.

As illustrated in FIG. 4, in a case where the image forming apparatus 101 performs duplex print, it is possible to perform the print in an interleaf mode where a plurality of recording papers 130 simultaneously remain on the conveyance path. In an eight-interleaf mode illustrated in (a), maximally eight recording papers 130 remain on the conveyance path, and the reversed first recording paper 130 is controlled such that the first recording paper 130 reaches the nip 106 of the secondary transfer belt 104 immediately after the secondary transfer with respect to a first surface of the eighth recording paper 130 is completed. After that, the recording paper 130 of which the first surface is planned to be printed and the reversed recording paper of which the second surface is planned to be printed are alternately supplied to the nip 106.

The image formation of the image forming unit 110 on each of the pages is also performed according to the timing. That is, the image forming unit 110, first, sequentially forms images of pages to be printed on the first surfaces of the first recording paper 130 to the eighth recording paper 130. At this time, the image formation of the images of each of the pages is performed at the interval of a print time X1 of one page. The image to be printed on the first surface of the eighth recording paper 130 is formed, and then, the image of each of the pages to be printed on the second surface is formed at the time of the interval, and thus, the image of the page to be printed on the first surface of the recording paper 130 and the image of the page to be printed on the second surface are alternately formed. The formation of the image of the page to be printed on the first surface is completed, and then, the formation of the image of each of the pages to be printed on the second surface is performed at the interval of X1.

However, in a case where the number of recording papers 130 to be used for the print is greater than the number of recording papers 130 simultaneously remain on the conveyance path, unless the print interval particularly increases, as illustrated in (a), the interval of the image formation of each of the pages is maximally X1. However, in a case where the number of recording papers 130 used for the print is less than the number of recording papers 130 simultaneously remain on the conveyance path, a longer interval may be provided.

(b) illustrates print timing in the case of printing both surfaces of one paper in the eight interleaf mode.

In this case, there is no image to be printed at timing illustrated by a broken line, and thus, the image formation is not performed. Accordingly, there is a period in which the image formation is not performed by a time of X2 from the image forming unit 110 forms the image to be printed on the first surface of the first recording paper 130 until the image to be printed on the second surface is formed. After that, whether there is a paper or not, the recording paper 130 of which the first surface has been printed is reversed, and thus, the time required for returning the recording paper 130 to the nip 106 is not changed, and therefore, such an interval is provided.

However, in order to improve a print efficiency, in a case where other print jobs occur within the period of X2 of (b), it is considered that print relevant to the print job is executed with interruption.

An example of (c) illustrates print timing in a case where the other print job occurs at the print timing of the fifth recording paper 130, and interruption print is performed. Even in the case of performing the interruption print, the print with respect to the first recording paper 130, which is initially executed, is not particularly affected.

In the example of (c), a period after the image to be printed on the first surface of the first recording paper 130 is formed until the next image formation is performed is X3. Accordingly, in consideration of the interruption print, a period required from an image of a certain page is formed until an image of the next page is formed may not be clear.

Here, the print timing determiner 153 determines whether the interruption print is executed at which timing of the recording paper 130 after the print instruction is received from the print controller 171, and thus, the timing of forming the next image is determined to a certain extent before the image forming unit 110 actually forms the image. For example, in the eight-interleaf mode, in a case where there is no request of the interruption print according to the timing of the eighth recording paper 130, at this time point, it is determined that the next image formation is the image to be printed on the second surface of the first recording paper 130. In this case, the timing of forming the next image is determined to a certain extent before the image forming unit 110 actually forms the image.

The number of recording papers 130, which are capable of simultaneously remaining on the conveyance path, is changed according to the size of the recording paper 130 in a sub-operation direction (a conveyance direction) of the linear velocity of the print. In response to this, as illustrated in (d) to (f), the image forming apparatus 101 is also capable of executing image formation of an interleaf mode in which the number of simultaneously remaining recording papers is different. Even in this case, control to the same effect of (b) or (c) can be performed.

The print timing of each of the pages can be changed due to various factors in addition to the interruption described above. For example, in a case where the post processing controller 312 performs the inter-paper request, the print timing of each of the pages behind the inter-paper is delayed such that the inter-paper can be ensured according to the request. In order to perform the post processing with respect to first five recording papers 130, the print on the second surface of the fifth recording paper 130 is performed, and then, the print on the second surface of the sixth recording paper 130 is performed at a predetermined time interval.

Alternatively, even in a case where the rendering processing in the print control device 401 takes time, and the image data is not supplied by the timing where the image data is required for the print, it is necessary to wait for the print of the next page until the image data is supplied. Even in this case, the print timing of each of the pages is shifted from the original schedule.

Next, timing at which the image forming apparatus 101 stops and restarts the operation developing unit 113 will be described by using FIG. 5 to FIG. 8. The operation stop of the developing unit 113 described here is performed while print relevant to one print job is executed. The operation stop after the print is ended may be performed by a suitable known method, separately from the operation stop described here.

In the image forming apparatus 101, the engine controller 151 generally stops and restarts the operation of the developing unit 113 on the basis of standards (1) to (5) described below. The control of the stop and the restart is individually performed with respect to each color.

(1) in a case where print timing of the next page is not yet determined at a time point where the primary transfer of one page is completed, the operation of the developing unit 113 is stopped after a third predetermined time T3 elapses. (2) in a case where print timing of the next page is determined at a time point where the primary transfer of one page is completed, and there is a time longer than a first predetermined time T1 until exposure (writing) start timing of the corresponding color, the operation of the developing unit 113 is stopped (in a case where the time is shorter than or equal to T1, the operation of the developing unit 113 has to be restarted in time to exposure start timing, and thus, the stop of the operation is not performed). (3) the operation of the developing unit 113 is restarted before T1 from the exposure (writing) start timing of the corresponding color according to the print timing of the next page. (4) at a time point where the print timing of the next page is determined, and the time until the exposure start timing of the corresponding color is shorter than or equal to T1, the operation of the developing unit 113 is immediately restarted. At this time, the print timing of the next page is adjusted to be delayed such that the exposure start timing of the corresponding color is after T1 from the present. (5) the operation of the developing unit 113 is restarted at a time point which elapses by a second predetermined time T2 after the operation of the developing unit 113 is stopped.

Both of (1) and (2) described above are also capable of being considered as a standard that in a case where it is not determined that the time until the exposure (writing) start timing of the next page is shorter than or equal to the first predetermined time T1 at a time point where the primary transfer of one page is completed, the operation of the developing unit 113 is stopped (as necessary, after waiting for T3).

The first predetermined time T1 is a start-up time required from an operation restart instruction of the developing unit 113 until a developing operation is usually performed by the developing unit 113.

The second predetermined time T2 is a time during which the developing unit 113 can be stopped while the photoconductor drum 114 of the image forming unit 110 is operated (rotated). In a case where the developing unit 113 is stopped, the developer is not supplied to the photoconductor drum 114, and thus, the lubricity of the surface of the photoconductor drum 114 decreases. In this state, in a case where the photoconductor drum 114 is operated for a long period of time, friction between a cleaning member for cleaning the surface of the photoconductor drum 114 and the photoconductor drum 114 increases, and thus, it is considered that the operation of the cleaning member may be adversely affected, such as turning over of a blade. For this reason, here, a period in which the developing unit 113 is stopped while the photoconductor drum 114 is operated (rotated) is maximally T2.

The meaning of the third predetermined time T3 will be described below by using FIG. 13.

FIG. 5 to FIG. 8 illustrate examples of the timing of stopping and starting the operation of the developing unit 113 according to the standard described above. In such drawings, a horizontal axis is a time axis, and each "primary transfer" of YMCK represents a signal state of the "transfer ON/OFF" of each color. In the "transfer ON/OFF", a high level is ON, a low level is OFF, and one period of the high level represents a period in which primary transfer of an image of one page is performed. "Developing" represents a signal state of the "developing ON/OFF". In the "developing ON/OFF", a high level is ON, a low level is OFF, the period of the high level is a period in which the developing unit 113 is operated, and the period of the low level is a period in which the operation of the developing unit 113 is stopped. In the drawing, the developing of only Y and M is illustrated, and each of C and K is capable of generating the signal of the "developing ON/OFF" according to the same effect of control.

Figure 5:
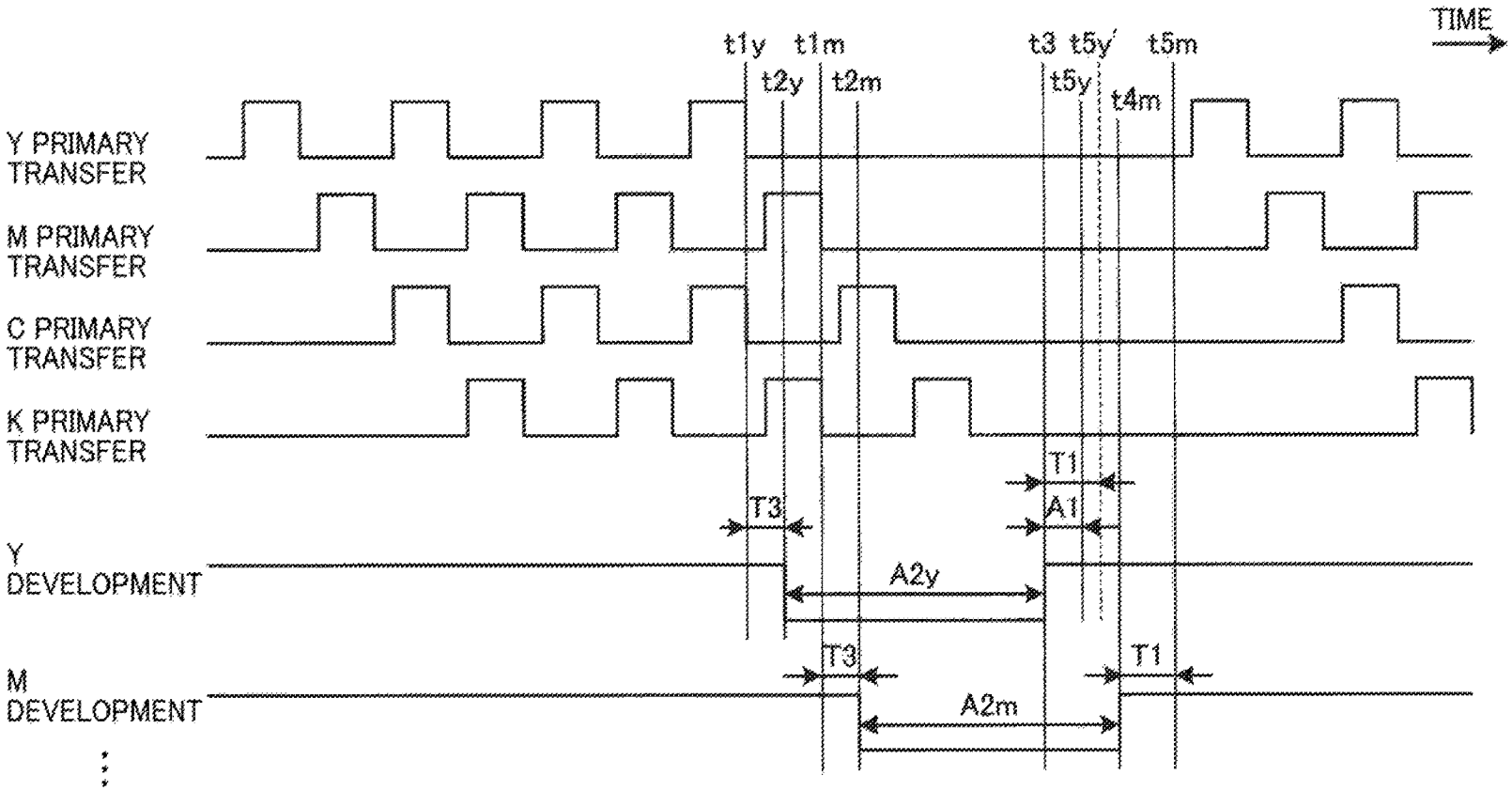
FIG. 5 is a diagram illustrating an example of timing at which the image forming apparatus illustrated in FIG. 1 stops and restarts the operation of the developing unit.

FIG. 5 illustrates an example of a case where the print timing of the next page is not determined at a time point where primary transfer of the fourth page is completed, and after that, the next page is printed for a comparatively short period of time.

In this example, the print timing of the next page is determined at a time point where primary transfer of the first page to the third page is ended, and the time until the exposure start timing is shorter than or equal to T1. Accordingly, dining this period, the developing unit 113 is not stopped with respect to any color.

After that, the print timing of the next page is not determined at a time t1*y* where primary transfer of the fourth page is completed, and thus, a developing unit 113Y of Y is stopped at a time t2*y* after T3 elapses, according to the standard (1). After that, in a case where the print timing of the next page is determined at the time t3, according to this, the exposure start timing of each color is determined.

Here, in a case where a time from t3 to exposure start timing t5*y* is A1 (<T1), the operation of the developing unit 113Y is immediately restarted according to the standard (4). The exposure start timing of Y is delayed from t3 (the restart of the operation of the developing unit 113Y) to a time t5*y*' after T1, and according to this, the exposure start timing of each of the other colors is also adjusted. In a case where such adjustment is performed, the standard (4) is applied only to a color having the earliest exposure start timing.

The print timing of the next page is not determined even at a time t1*m* where primary transfer of M of the fourth page is completed, and thus, a developing unit 113M of M is stopped at the time t2*m* after T3 elapses, according to the standard (1).

In M, a time from the time point t3 to the exposure start timing t5*m* after the adjustment is longer than or equal to T1, and thus, the operation of the developing unit 113M is restarted at a time t4*m* before T1 after the exposure start timing t5*m*, according to the standard (3).

According to the operation, print timing of the fifth page is slightly delayed from timing which is initially determined, each developing unit 113 can be stopped only during periods represented by A2*y* and A2*m*, and the consumption of the developer can be suppressed during such periods. Such consumption suppressing effect can be obtained even in a case where the print timing of the next page is not clear after the primary transfer is completed. The delay of the print timing only occurs in a rare case such as a case where a period from the determination of the timing to the start of the exposure is extremely short, and the width of the delay is not greatly wide, and thus, an influence on a print production efficiency is small.

Figure 6:
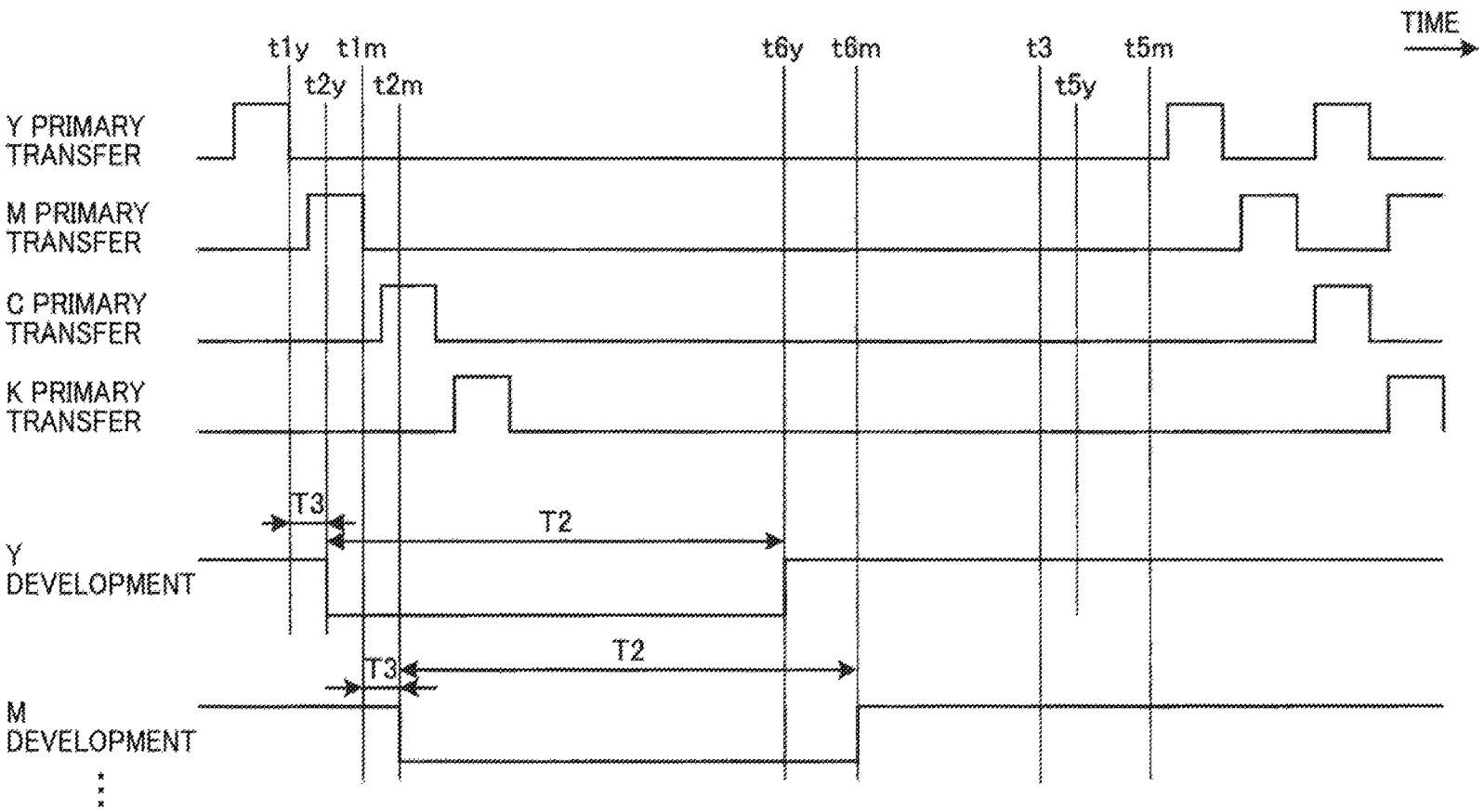
FIG. 6 is a diagram illustrating an example of timing at which the image forming apparatus illustrated in FIG. 1 stops and restarts the operation of the developing unit.

FIG. 6 illustrates an example of a case where the print timing of the next page is not determined at the time point where the primary transfer of the first page is completed, and after that, the next page is printed for a comparatively long period of time.

In this example, the print timing of the next page is not determined at the time t1*y* where the primary transfer of Y of the first page is completed (the same applies to M using the same reference numeral as t1*y* of FIG. 5 from the meaning that the time t1*y* is a standard time of stopping the developing unit 113), and thus, the developing unit 113Y of Y is stopped at the time t2*y* after T3 elapses, according to the standard (1).

After that, in the example of FIG. 6, T2 elapses from the stop of the developing unit 113Y before the print timing of the next page is determined at the time t3. For this reason, the operation of the developing unit 113Y is restarted at a time t6*y* after T2 from the time t1*y*, according to the standard (5). After that, the print timing of the next page is determined at the time point t3, and the exposure start timing of Y becomes t5*y*, but the operation of the developing unit 113Y is continued as it is.

The print timing of the next page is not determined even at the time t1*m* where the primary transfer of M of the first page is completed, and thus, the developing unit 113M of Y is stopped at the time t2*m* after T3 elapses, according to the standard (1). A point that the operation of the developing unit 113Y is restarted at a time t6*m* after T2 according to the standard (5) is also identical to the case of Y.

According to the operation, each developing unit 113 can be stopped only during T2, and the consumption of the developer can be suppressed during such a period. The print timing is not adversely affected. The upper limit of the period in which the developing unit 113 is stopped is set to T2, and thus, the cleaning member is not affected.

Figure 7:
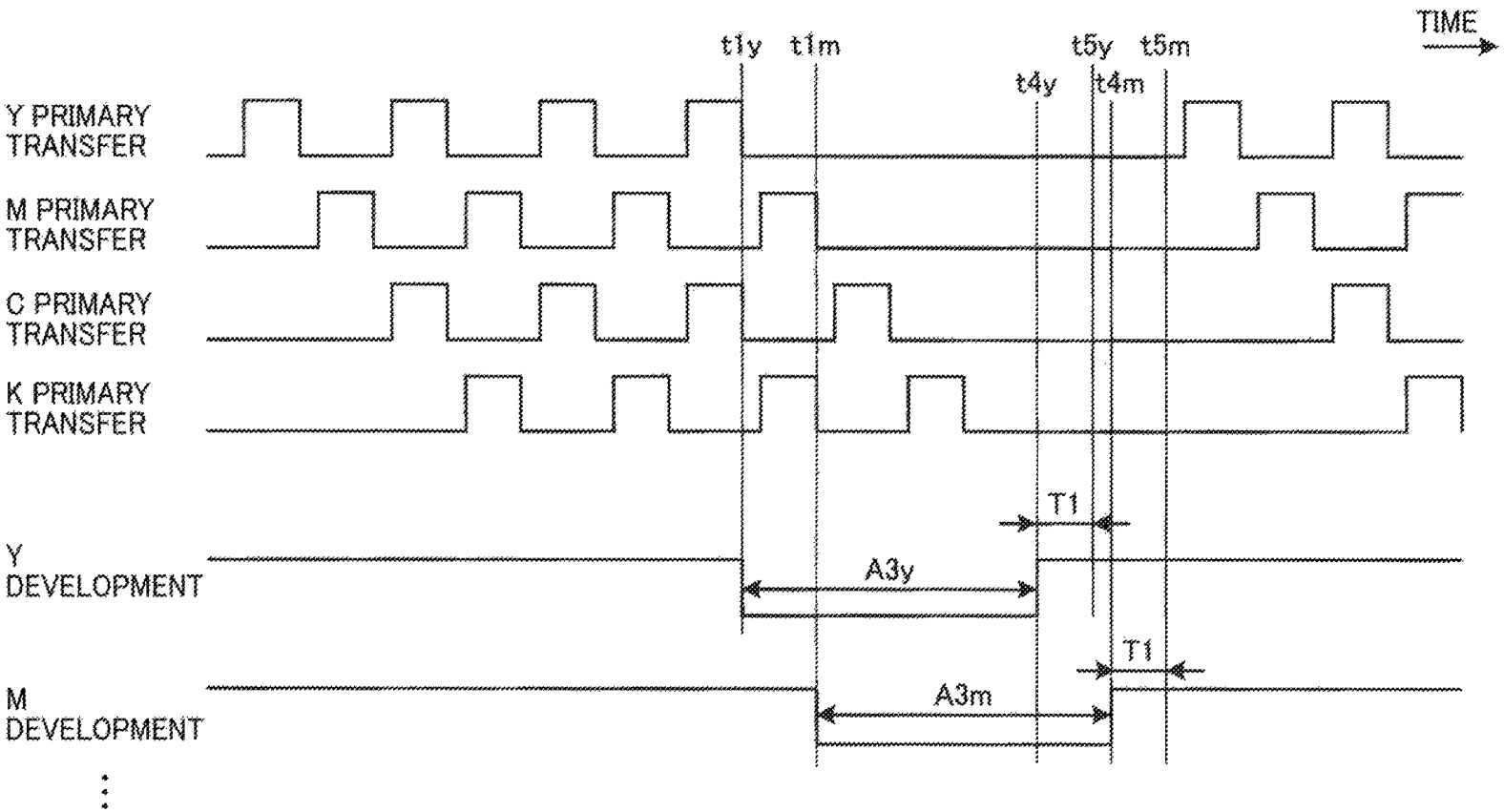
FIG. 7 is a diagram illustrating an example of timing at which the image forming apparatus illustrated in FIG. 1 stops and restarts the operation of the developing unit.

FIG. 7 illustrates an example of a case where the print timing of the next page is determined at the time point where the primary transfer of the fourth page is completed, and after that, the next page is printed for a comparatively short period of time. The print timing up to the fourth page is identical to that of the example of FIG. 5.

In this example, the print timing of the next page is determined at the time t1*y* where the primary transfer of Y of the fourth page is completed, and there is a time which is longer than T1 until the exposure start timing t5*y* of Y of the next page. For this reason, the developing unit 113Y is stopped at the time t1*y*, according to the standard (2).

In this example, the exposure start timing t5*y* is determined in advance at the time point t1*y*, and thus, the operation of the developing unit 113Y can be restarted at the time t4*y* before T1 unlike the case of FIG. 5, and the operation of the developing unit 113Y is restarted at the time t4*y*, according to the standard (3).

Similarly, in M, the operation of the developing unit 113M is stopped at the time t1*m* where the primary transfer of the fourth page is completed, and the operation of the developing unit 113M is restarted at the time t4*m* before T1 from the exposure start timing t5*m* of M of the next page.

According to the operation, each developing unit 113 can be stopped only during periods represented by A3*y* and A3*m*, and the consumption of the developer can be suppressed during such periods. The print timing is not adversely affected. In this example, waiting for T3 is performed after the primary transfer is ended, but as described below, in a case where the print timing of the next page is known at the time point where the developing unit 113 is stopped, the waiting for T3 is not necessary, and the waiting for T3 is omitted, and thus, the period in which the developing unit 113 is stopped can be elongated by the omitted waiting for T3.

Figure 8:
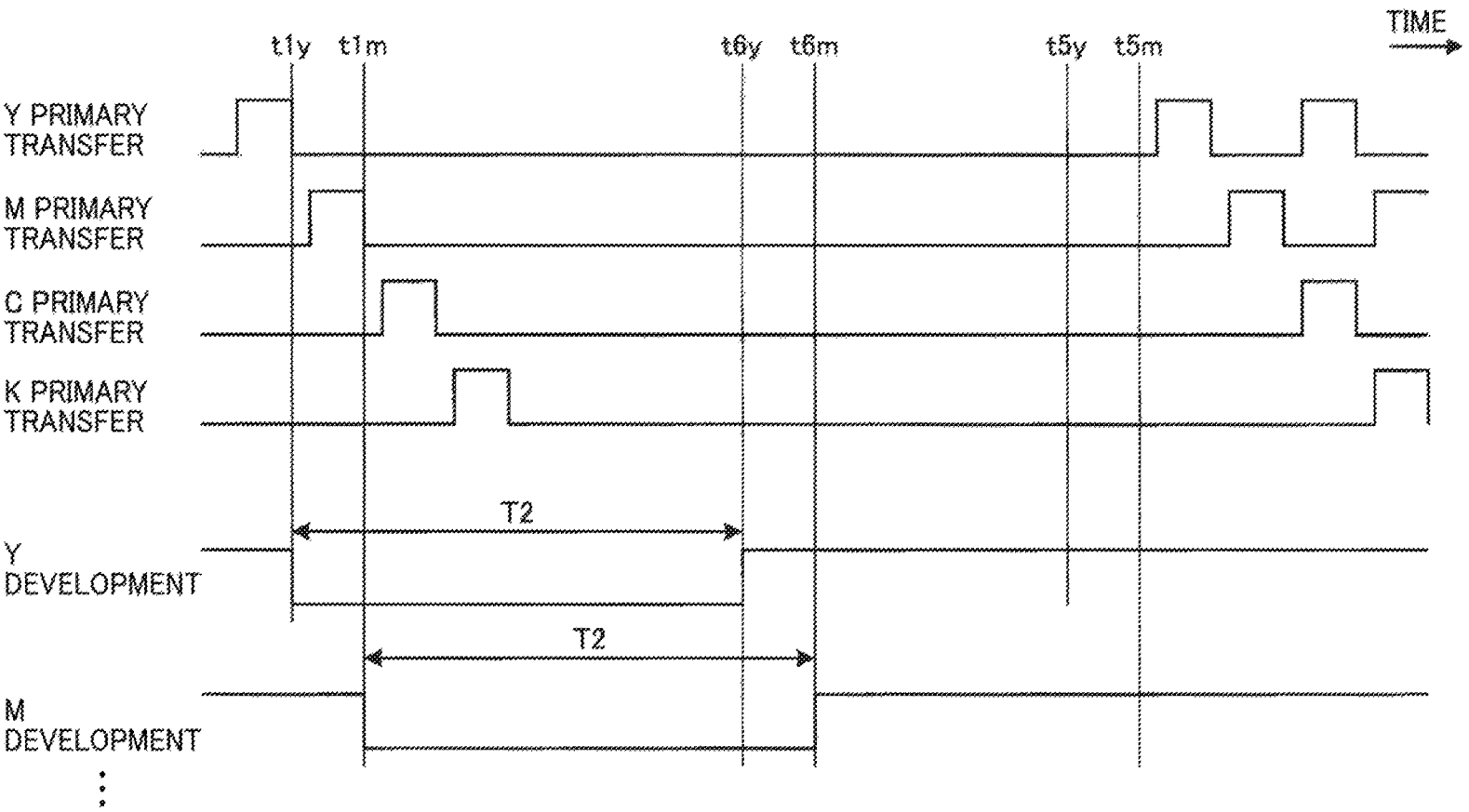
FIG. 8 is a diagram illustrating an example of timing at which the image forming apparatus illustrated in FIG. 1 stops and restarts the operation of the developing unit.

FIG. 8 illustrates an example of a case where the print timing of the next page is determined at the time point where the primary transfer of the first page is completed, and after that, the next page is printed for a comparatively long period of time. In a case where the interruption print is not set, such a case can be obtained.

Even in this example, the print timing of the next page is determined at the time t1*y* where the primary transfer Y of the first page is completed, and there is a time which is longer than T1 until the exposure start timing t5*y* of Y of the next page. For this reason, the developing unit 113Y is stopped at the time t1*y*, according to the standard (2).

After that, T2 elapses from the stop of the developing unit 113Y at the time t6*y* before longer than or equal to T1 from the exposure start timing t5*y* of Y. For this reason, the operation of the developing unit 113Y is restarted at this time point, according to the standard (5). After that, the operation of the developing unit 113Y is continued as it is until the next page is printed.

The same control is performed with respect to M, and the developing unit 113M is stopped at the time t1*m* where the primary transfer of the first page is completed, according to the standard (2), and the operation of the developing unit 113M is restarted at the time t6*m* after T2.

According to the operation, each developing unit 113 can be stopped only during T2, and the consumption of the developer can be suppressed during such a period. The print timing is not adversely affected. The upper limit of the period in which the developing unit 113 is stopped is set to T2, and thus, the cleaning member is not affected.

Figure 9A:
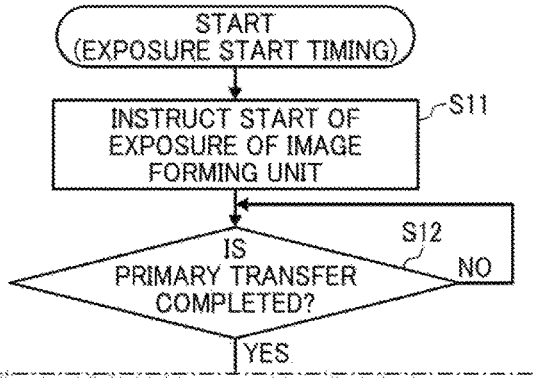
FIGS. 9A and 9B (FIG. 9) are a flowchart of processing for controlling the stop and the restart of the operation of the developing unit, which is executed by an engine controller illustrated in FIG. 2.
Figure 9B:
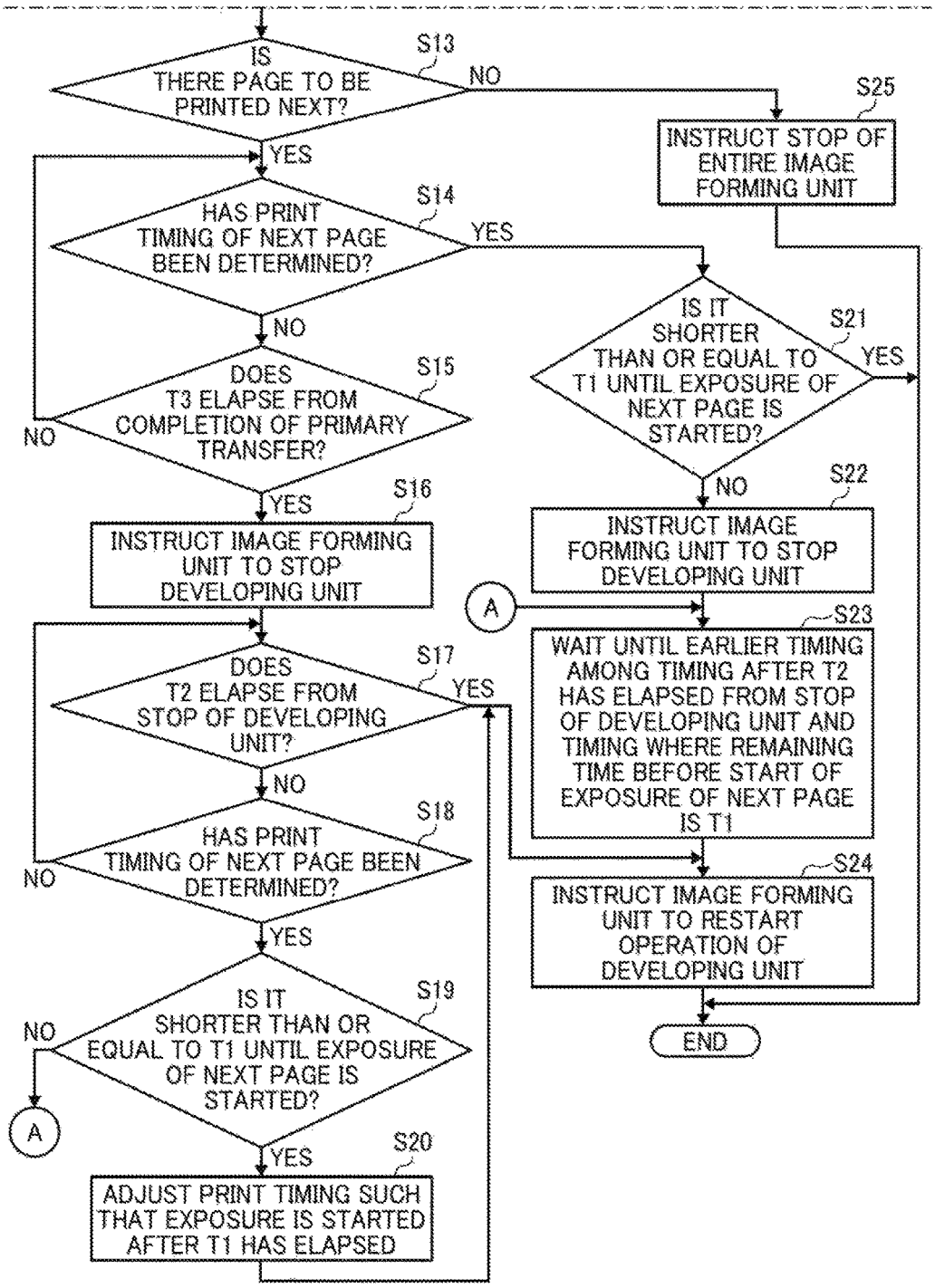

Next, FIG. 9 illustrates a flowchart of processing for controlling the stop and the restart of the operation of the developing unit 113 according to the standards (1) to (5) described above. The processing is performed by a processor of the engine controller 151 by executing a predetermined program, but it will be described that the engine controller 151 executes the processing of each step. FIG. 9 illustrates processing relevant to the control of the developing unit 113 of one color, and the engine controller 151 executes the processing of FIG. 9 with respect to each color of YMCK. Here, the common processing of each color, such as determination of the print timing, may be performed in common. The processing of FIG. 9 also includes processing relevant to determination of a standard which is more delicate than the standards (1) to (5).

The engine controller 151 starts the processing illustrated in the flowchart of FIG. 9 at exposure start timing of each page.

In this processing, first, the engine controller 151 turns on the exposure signal and instructs the image forming unit 110 to start the exposure (S11). The processing is identical to that of the related art. After that, the engine controller 151 waits until the primary transfer of one page is completed (S12). During this, processing required for forming an image of one page is executed as necessary.

After that, the engine controller 151 determines whether or not there is a page to be printed next (S13). In a case where it is determined which page is print next not only in the next page of the print job during the execution but also in other print jobs, the determination is Yes. Here, in the case of No, it is expected that the print is not performed for a while, and thus, the engine controller 151 instructs the image forming unit 110 to stop the entire image forming unit 110 (S25), and the processing of FIG. 9 is ended.

In the case of Yes in Step S13, the engine controller 151 determine whether or not the print timing of the next page has been determined (S14). Here, in a case where the print timing of the next page has not been determined, the engine controller 151 waits until the third predetermined time T3 elapses from the completion of the primary transfer, corresponding to the standard (1) described above (S15). However, even during this time, monitoring of whether or not the print timing of the next page has been determined is continued.

In a case where T3 elapses in a state where the print timing of the next page is not determined (Yes of S15), the engine controller 151 turns off the developing signal, and instructs the image forming unit 110 to stop the developing 113 according to the standard (1) (S16). After that, the engine controller 151 waits until it is determined whether the second predetermined time T2 elapses from the stop of the developing unit 113 or the print timing of the next page is determined (S17 and S18).

In a case where T2 elapses from the stop of the developing unit 113 (Yes of S17), the engine controller 151 turns on the developing signal, and instructs the image forming unit 110 to restart the operation of the developing unit 113 according to the standard (5) (S24), and the processing of FIG. 9 is ended.

In a case where the print timing of the next page is determined (Yes) of S18), the engine controller 151 determines whether or not a time until the exposure of the next page is started is shorter than or equal to the first predetermined time T1 (S19). Here, in the case of Yes, the print timing of the next page is adjusted such that the exposure is started after T1 has elapsed from the time point of the processing (S20), and after that, the engine controller 151 instructs the image forming unit 110 to restart the operation of the developing unit 113 according to the standard (4) (S24), and the processing of FIG. 9 is ended. In the case of No in Step S19, the engine controller 151 does not immediately stops the operation of the developing unit 113, and waits until earlier timing among timing after T2 has elapsed from the stop of the developing unit 113 and timing where remaining time before start of exposure of next page is T1 (S23). After that, in a case where the former is earlier, the engine controller 151 instructs the image forming unit 110 to restart the operation of the developing unit 113 according to the standard (5), in a case where the latter is earlier, the engine controller 151 instructs the image forming unit 110 to restart the operation of the developing unit 113 according to the standard (3) (S24), and the processing of FIG. 9 is ended.

In the case of Yes in Step S14, the engine controller 151 determines whether or not the time until the exposure of the next page is started is shorter than or equal to the first predetermined time T1 (S21). In the case of No, the engine controller 151 turns off the developing signal, and instructs the image forming unit 110 to stop the developing unit 113 (S22), and the process proceeds to processing after Step S23.

In the case of Yes in Step S14 immediately after Step S13, processing of Steps S21 and S22 are processing of stopping the developing unit 113 according to the standard (2). After Step S13, Yes may be obtained in Step S14 through S15, and this is a case where the print timing of the next page is determined while waiting for T3 according to the standard (1). In a case where the print timing of the next page is determined, it is not necessary to wait for T3, and thus, in this case, the operation of the developing unit 113 is stopped without waiting for the elapse of T3 in a case where the operation of the developing unit 113 can be restarted until the timing at which the exposure of the next page is started.

In the case of Yes in Step S21, the operation of the developing unit 113 is not restarted to be in accordance with the exposure start timing, and thus, the engine controller 151 does not stop the developing unit 113, and the processing of FIG. 9 is ended.

In the processing described above, processing relevant to the standards (1) and (2) is processing of a first control procedure, and the engine controller 151 performs such processing functions as a first controller.

Processing relevant to the standard (3) and (4) is processing of a second control procedure, and the engine controller 151 performing such processing functions as a second controller.

Processing relevant to the standard (5) is processing of a third control procedure, and the engine controller 151 performing such processing functions as a third controller.

Figure 10:
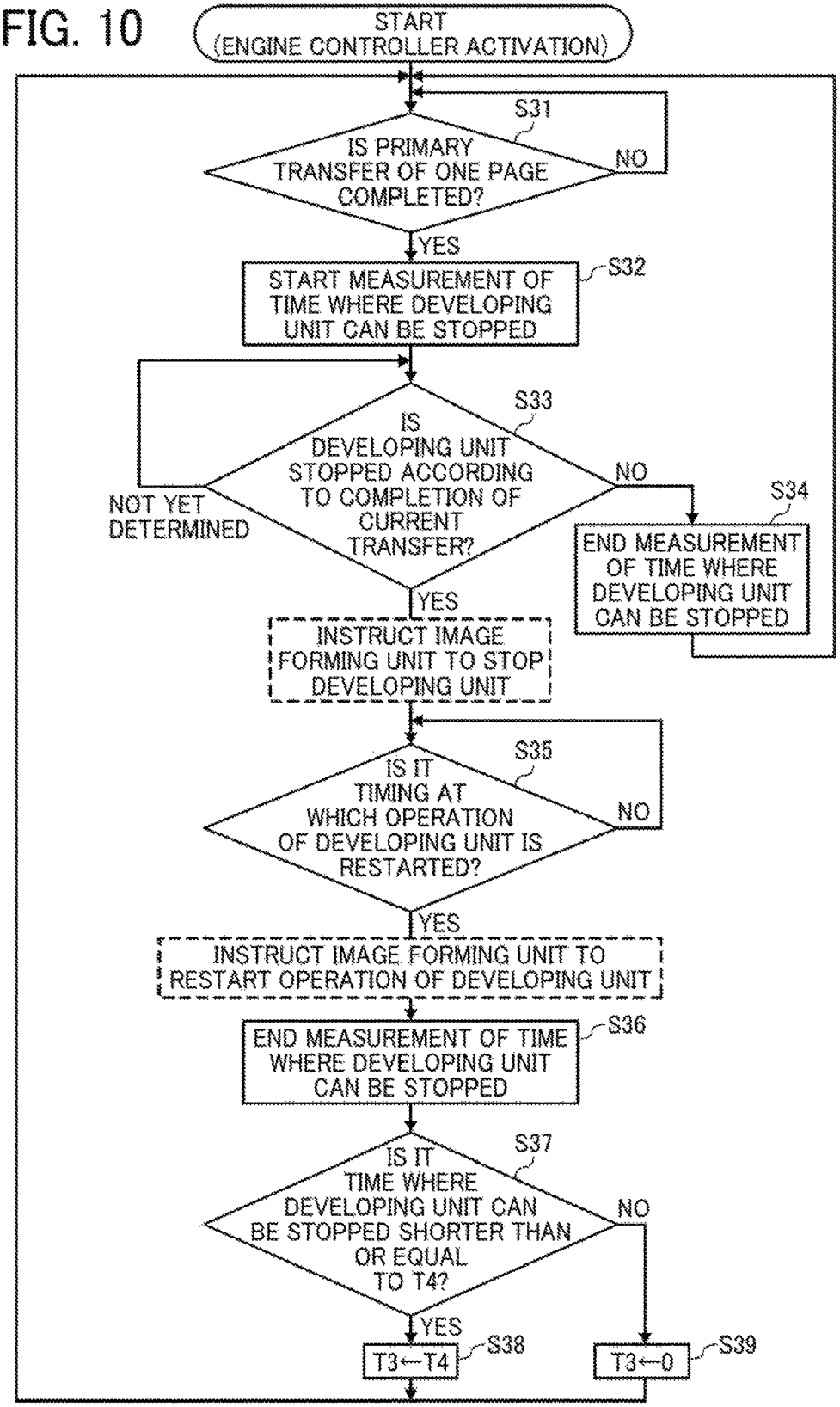
FIG. 10 is a flowchart of processing for setting a third predetermined time T3, similarly.

Next, FIG. 10 illustrates a flowchart of processing for setting the third predetermined time T3. The third predetermined time T3 may be arbitrarily set by the user, and the image forming apparatus 101 has a function of automatically setting T3 by the processing of FIG. 10. As with the case of FIG. 9, the processing of FIG. 10 will be described such that the engine controller 151 executes the processing of each step. As with the case of FIG. 9, such processing is also executed with respect to each color of YMCK.

In a case where the engine controller 151 is activated, the processing illustrated in the flowchart of FIG. 10 is started. In such processing, the engine controller 151 waits until primary transfer of any one page is completed (S31), and in a case where the primary transfer is completed, the engine controller 151 starts measurement of a time where the developing unit can be stopped (S32). At this time, the previous measurement result is reset.

Next, the engine controller 151 determines whether or not the operation of the developing unit 113 is stopped by the processing of FIG. 9 according to the completion of the current transfer (S33). In a case where the determination result is not yet determined such as case of waiting for T3, the engine controller 151 waits until the result is determined. In a case where operation of the developing unit 113 is not stopped, the measurement of the time where the developing unit can be stopped is ended (S34), and the process is returned to Step S31. In the case of No in Step S13 of FIG. 9, only the developing unit 113 is not stopped, and thus, No is obtained in Step S33 of FIG. 10.

In the case of Yes in Step S33, the engine controller 151 instructs the image forming unit 110 to stop the developing unit 113 by the processing of Step S16 or S22 of FIG. 9. After that, the engine controller 151 waits until timing at which the operation of the developing unit 113 is restarted (S35). At the timing at which the operation of the developing unit 113 is restarted (timing of executing Step S24 of FIG. 9), the engine controller 151 ends the measurement of the time where the developing unit can be stopped (S36).

At this time point, the measurement result of the time where the developing unit can be stopped is a value representing the length of a period in which the operation of the developing unit 113 is stopped. In a case where the time where the developing unit can be stopped is shorter than or equal to a fourth predetermined time T4 (for example, 2 seconds (S37), the engine controller 151 adopts the fourth predetermined time T4 as the value of the third predetermined time T3 (S38), or otherwise, sets the value of T3 to 0 seconds (S39). After that, the process is returned to Step S31, and the processing is repeated.

That is, in a case where the period in which the operation of the developing unit 113 is stopped according to the processing of FIG. 9 is short, the value of T3 is set to a value greater than 0, and in a case where a certain period of time where the operation of the developing unit 113 is stopped can be ensured, the value of T3 is set to 0. The effect will be described below with reference to FIG. 13. Here, in Step S38, T4 which is identical to a determination standard of Step S37 is adopted as the value of T3, but a different value may be adopted.

In the processing described above, the engine controller 151 functions as a measurement unit in Steps S31 to S36 using a timer, and functions as a setting unit using a processor in Steps S37 to S39. The user may switch the validity and invalidity of the function relevant to the processing of FIG. 10 described above.

Figure 11:
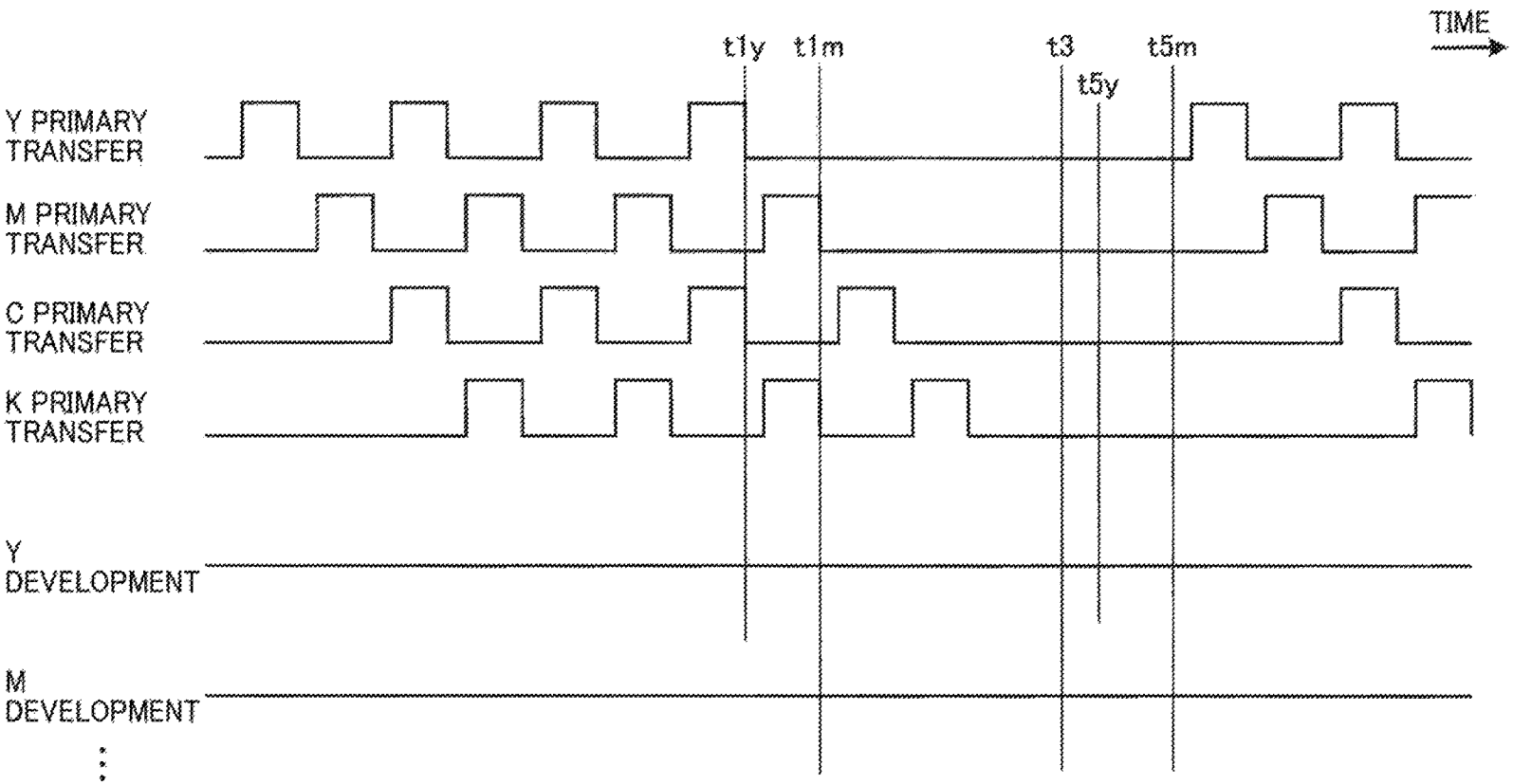
FIG. 11 is a diagram illustrating an example of timing at which an image forming apparatus of a first comparative example of the first embodiment stops and restarts the operation of the developing unit.
Figure 12:
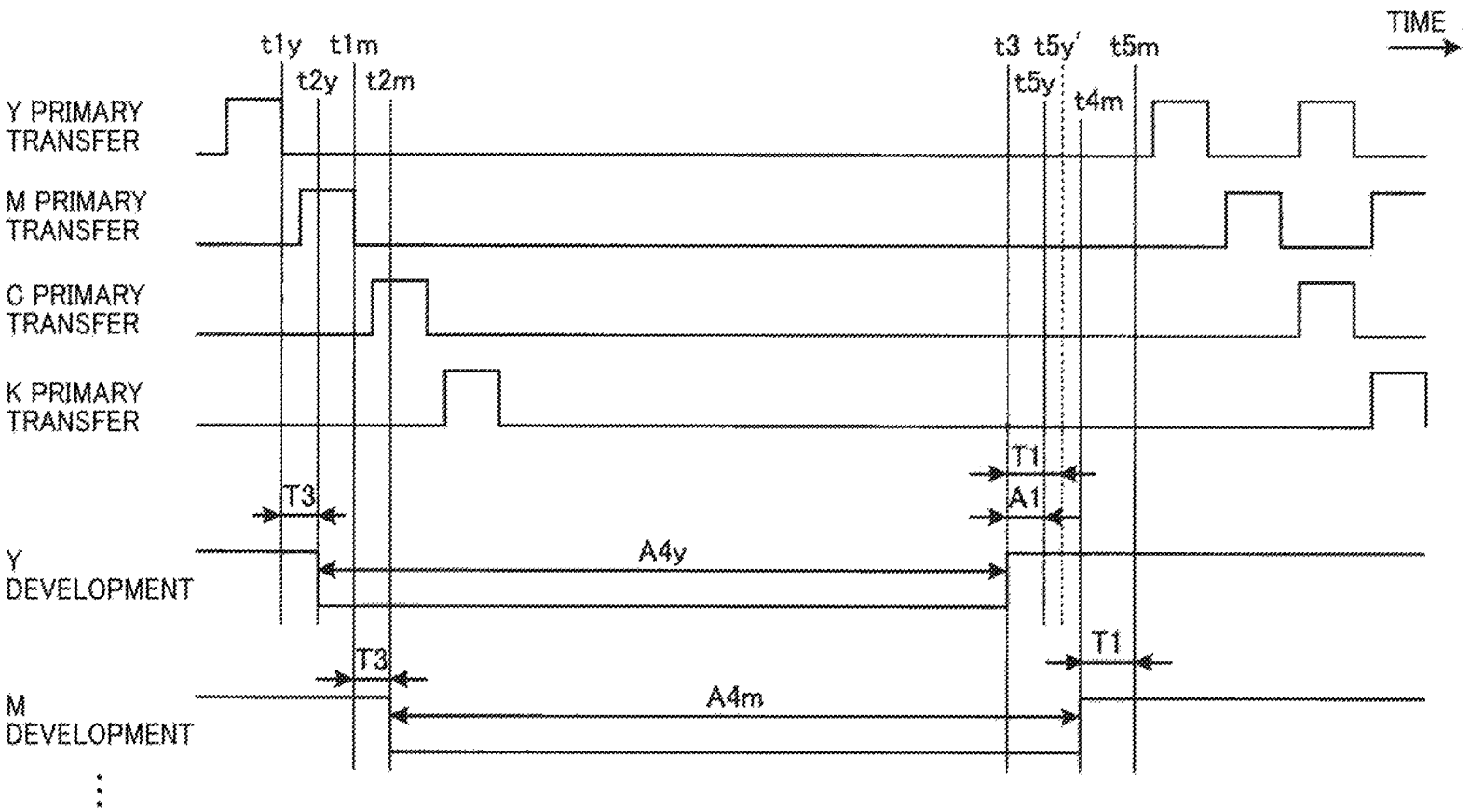
FIG. 12 is a diagram illustrating an example of timing at which an image forming apparatus of a second comparative example of the first embodiment stops and restarts the operation of the developing unit.

Comparative Examples of First Embodiment: FIG. 11 to FIG. 13

Next, the effect of the first embodiment, which has been described, will be described by using FIG. 11 to FIG. 13.

First, FIG. 11 illustrates timing corresponding to FIG. 5, in a case where the developing unit 113 is not stopped, as a first comparative example.

In this case, the operation of the developing unit 113 is not stopped between the time t1*y* and the time t5*y* or between the time t1*m* and the time t5*m*. Accordingly, the consumption of the developer at the time of forming the same image increases compared to the first embodiment illustrated in FIG. 5, and thus, the cost increases. In contrast, the developing unit 113 is stopped as illustrated in FIG. 5, and thus, the consumption of the developer can be suppressed.

FIG. 12 illustrates timing corresponding to FIG. 6, in a case where the operation of the developing unit 113 is not restarted after T2 elapses from the stop of the developing unit 113, as a second comparative example.

In this case, as with the case of FIG. 5, the operation of the developing unit 113Y of Y which is stopped at the time t2*y*, is restarted a time point where the print timing of the next page is determined at the time t3. As with the case of FIG. 5, the operation of the developing unit 113M of M, which is stopped at the time t2*m*, is restarted at the time t4*m*.

Accordingly, the developing units 113Y and 113M are respectively stopped by periods represented by A4*y* and A4*m*, and thus, the consumption of the developer can be suppressed. However, in a case where only the developing unit 113 is stopped for a long period of time in a state where the photoconductor drum 114 is operated, the lubricity of the surface of the photoconductor drum 114 decreases, and thus, there is a possibility that the cleaning member is adversely affected.

However, as illustrated in FIG. 6, the operation of the developing unit 113 is restarted after T2 elapses from the stop of the developing unit 113, and thus, it is possible to reduce the consumption of the developer while avoiding the adverse influence.

Figure 13:
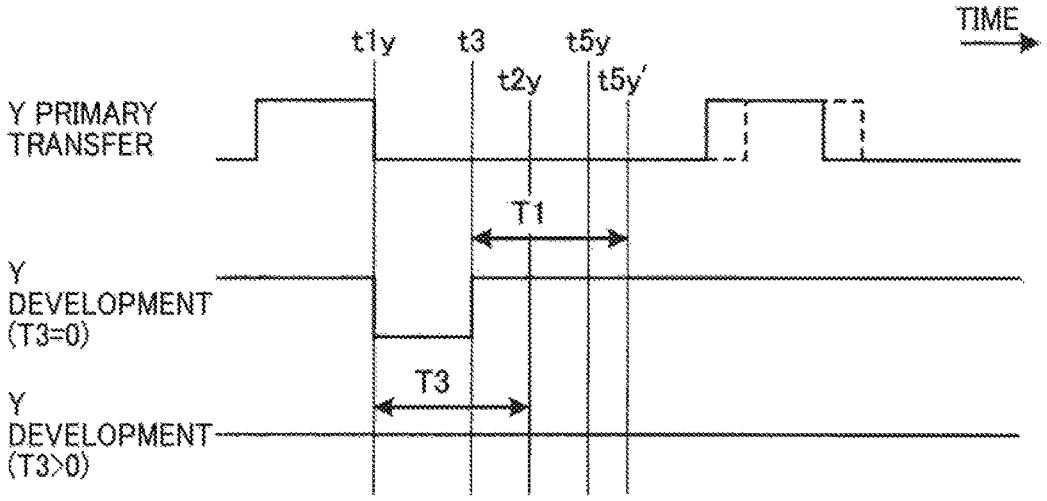
FIG. 13 is a diagram illustrating an example of timing at which an image forming apparatus of a third comparative example of the first embodiment stops and restarts the operation of the developing unit.

Next, FIG. 13 illustrates an example of timing of stopping and starting the operation of the developing unit 113 in a case where the value of T3 is 0 and a case where the value of T3 is greater than 0.

The example of FIG. 13 is different from FIG. 5 or the like in the scale reduction of the time axis, and illustrates the primary transfer and the timing of the operation of the developing unit 113 only with respect to Y.

In the example of FIG. 13, the print timing of the next page is determined at the time t3 immediately after the time t1*y* which is a time point where primary transfer of the N-th page is completed. In the image forming apparatus 101, even in a case where each page is printed without any break, the engine controller 151 is not capable of obtaining the image data of the next page until primary transfer of the previous page is ended due to the fact that there is a page which incidentally takes time to the rendering processing of the print control device 401, and thus, there is a case where the print timing is not capable of being determined. In this case, in a normal situation, the print timing of the next page has been determined at the time point of the time t1*y*, and thus, it is normally considered that an interval between the time t1*y* and the time t3 is short even in a case where the timing is slightly delayed.

However, in a case where the value of T3 is 0, the engine controller 151 immediately stops the operation of the developing unit 113 at this time point in a case where the print timing of the next page is not determined at the time t1*y*. As with the case of FIG. 5, in a case where a time until the exposure start timing t5*y* of Y of the next page is shorter than or equal to T1 at the time t3, the engine controller 151 restarts the operation of the developing unit 113 at the time t3, according to the standard (4). The print timing of the next page is delayed such that the exposure start timing of Y becomes the time t5*y*'.

Accordingly, in order to stop the developing unit 113 only for a short period of time from the time t1*y* to the time t3, the print timing of the next page is delayed. In a case where the stop and the restart of the operation of the developing unit 113 are repeated for a short period of time, it is considered that a driving unit such as a motor is also adversely affected, and thus, it is not preferable from such a viewpoint.

In a case where the value of T3 is a value longer than the time from the time t1*y* to the time t3, the engine controller 151 still waits for T3 after the time t1*y* at the time point of the time t3, and the developing unit 113 is not stopped. The engine controller 151 determines that the time until the exposure start timing t5*y* of Y of the next page is shorter than T1 according to determination of the print timing of the next page at the time t3, and thus, here, the developing unit 113 is not stopped, and the developing unit 113 is not stopped between the N-th page and the N+1-th page. Accordingly, the print timing is not delayed.

Thus, in a case where the print timing of the next page is not determined at a time point where primary transfer of a certain page is completed, the engine controller 151 waits for the time T3 longer than or equal to 0 before the developing unit 113 is stopped, and thus, even in a case where the determination of the print timing of the next page is delayed due to an unexpected situation, it is possible to prevent the operation of the developing unit 113 from being stopped and restarted for a short period of time, and to prevent the delay of the print timing or an adverse influence on the driving unit.

However, in the case such as FIG. 5, in a case where the engine controller 151 waits for the time T3, the time where the developing unit 113 is stopped shortens by T3. For this reason, in general, T3 is set to 0, and in a case where the operation of the developing unit 113 is stopped and restarted for a short period of time as illustrated in FIG. 13, the value of T3 may be set to a predetermined value greater than 0. According to this, it is possible to ensure the time where the developing unit 113 is stopped and to prevent a problem which occurs due to the fact that the operation of the developing unit 113 is stopped and restarted for a short period of time. Processing for performing such setting is the processing of FIG. 10.

Second Embodiment: FIG. 14 to FIG. 19

Next, a second embodiment of the present invention will be described. An image forming apparatus of the second embodiment is different from the first embodiment in that in a case where predetermined conditions are satisfied during the execution of the print job, control of stopping the operation of the image forming part including the entire image forming unit 110 and the intermediate transfer belt 103 is performed, in addition to the stop of the developing unit described in the first embodiment.

Other points are identical to those of the first embodiment, and thus, in the second embodiment, only a difference from the first embodiment, which is relevant to the above description, will be described. The same reference numerals are also used for the same configurations as those of the first embodiment.

In the first embodiment, it is described that the image forming device 102 is the image forming part, but in the second embodiment, the image forming part, which is a target to be stopped during the execution of the print job, is the image forming unit 110 and the intermediate transfer belt 103. That is, it is not necessary to stop the paper feeding device 105, a conveyance mechanism conveying the recording paper 130, and the like. However, a range to be stopped is not limited thereto, and can be suitably changed.

Figure 14:
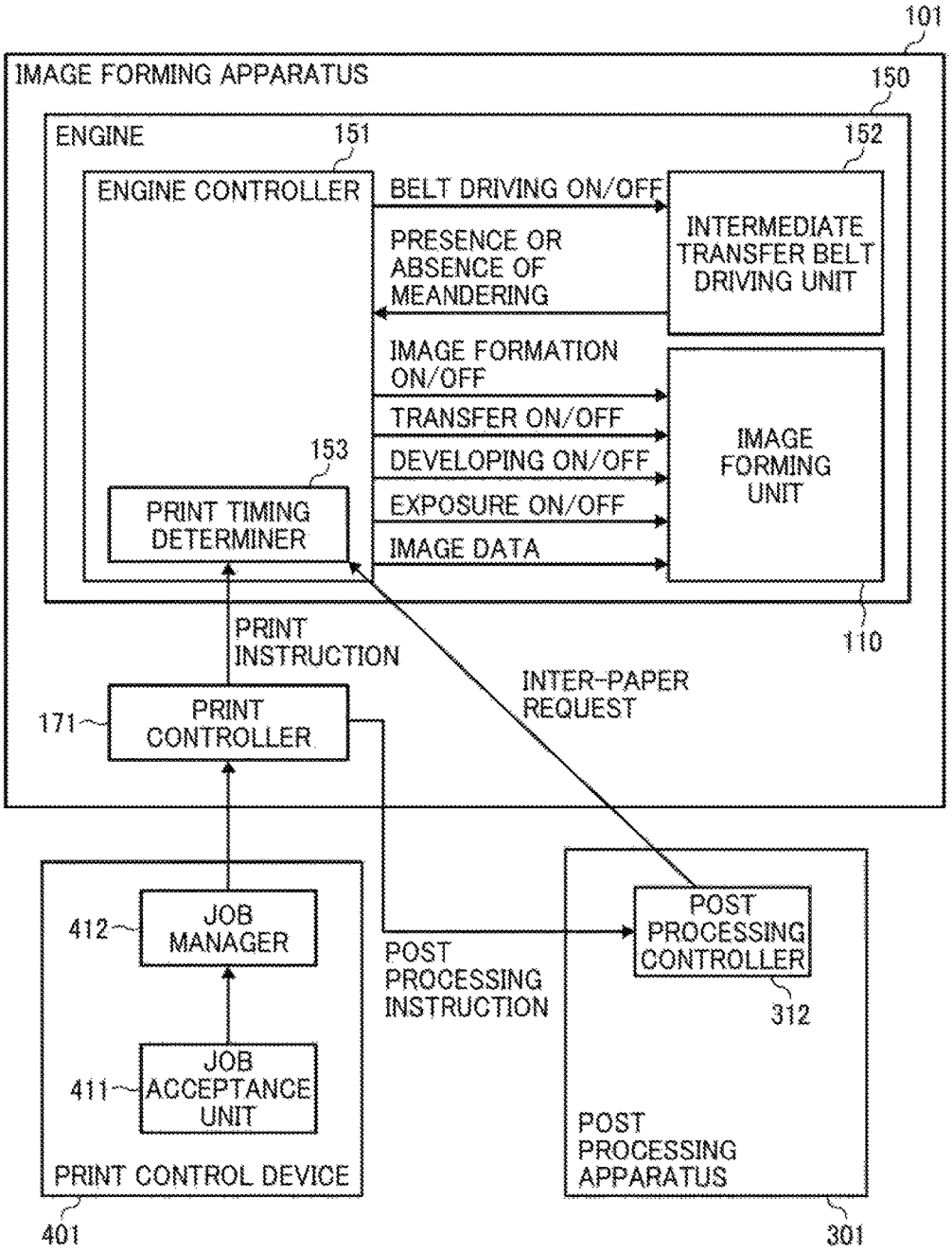
FIG. 14 is a diagram corresponding to FIG. 3, which illustrates a schematic configuration of a function provided in an image forming apparatus of a second embodiment and a peripheral device thereof.

First, FIG. 14 illustrates a schematic configuration of a function relevant to timing control of print including the stop and the restart of the operation of the developing unit 113, the image forming unit 110, and the intermediate transfer belt 103 provided in the image forming apparatus 101 of the second embodiment and the peripheral device thereof.

The configuration illustrated in FIG. 14 is approximately identical to the configuration illustrated in FIG. 3, but is different from the configuration illustrated in FIG. 3 in that an intermediate transfer belt driving unit 152 is added to the engine 150, and "image formation ON/OFF" is added as a signal supplied from the engine controller 151 to the image forming unit 110.

The intermediate transfer belt driving unit 152 is a driving unit for bridging the intermediate transfer belt 103 and for driving the intermediate transfer belt 103 towards a longitudinal direction, such as a roller and a motor. The intermediate transfer belt driving unit 152 also includes a sensor for detecting whether or not the intermediate transfer belt 103 meanders.

The engine controller 151 supplies a driving signal of "belt driving ON/OFF" to the intermediate transfer belt driving unit 152, and instructs driving ON/OFF of the intermediate transfer belt 103. The intermediate transfer belt driving unit 152 supplies information of "the presence or absence of the meandering" on the basis of the detection result of a meandering sensor to the engine controller 151. In the image forming apparatus 101, in a case where the image forming unit 110 and the intermediate transfer belt 103 are activated, a time until the intermediate transfer belt 103 can be driving without meandering is maximized during such an activation process, and it is difficult to expect a required time. Accordingly, in this embodiment, the detection result of the presence or absence of the meandering of the intermediate transfer belt 103 is important, in the timing control of the print.

The "image formation ON/OFF" is a control signal for instructing the image forming unit 110 to turn on and off the operation of the entire image forming unit 110 from the engine controller 151. Such a signal is also individually supplied to the image forming unit of each color, as with the signal such as the "developing ON/OFF", The "image formation ON/OFF" is a signal instructing ON/OFF of the operation of the entire image forming unit 110, including each unit of which ON/OFF is controlled by each control signal such as the "transfer ON/OFF", the "developing ON/OFF", and the "exposure ON/OFF" described in FIG. 3. Accordingly, in a case where the "image formation ON/OFF" is turned off, the operation of the entire image forming unit 110 is maintained in the state of OFF even in a case where other control signals are turned on.

In FIG. 14 described above, each of the units and the signal added from FIG. 3 are also provided in the image forming apparatus 101 of the first embodiment, but are not control targets of particular attention in the first embodiment. In the second embodiment, each of the units and the signal attract attention, and thus, are explicitly illustrated the drawing.

Next, timing will be described at which the image forming apparatus 101 of the second embodiment stops and restarts the operation of the developing unit 113, the image forming unit 110, and the intermediate transfer belt 103, by using FIG. 15 to FIG. 17. The stop of the operation of the developing unit 113, the image forming unit 110, and the intermediate transfer belt 103 described here, is performed during the execution of the print relevant to one print job. The operation stop after the print is ended may be performed by a suitable known method, separately from the operation stop described here.

In the image forming apparatus 101 of the second embodiment, the engine controller 151 stops the operation of the developing unit 113 according to the same standard as (1) and (2) described in the first embodiment. In a case where the operation of the image forming unit 110 and the intermediate transfer belt 103 is not stopped, the operation of the developing unit 113 is restarted according to the same standard as (3) to (5). In addition to this, the operation of the image forming unit 110 and the intermediate transfer belt 103 is generally stopped and restarted according to the following standards (A) to (D).

The control of stopping and restarting the image forming unit 110 and the intermediate transfer belt 103 is performed on the basis of image forming timing of one specific color. Here, one specific color will be described as Y of a color to be initially subjected to image formation (hereinafter, referred to as a "head color") in the image forming unit 110 of each color, but is not limited thereto. For example in a case where only the image forming unit 110 of K is used at the time of performing monochrome image formation, it is possible to perform the same control based on image forming timing of K.

(A) in a case where print timing of the next page is not yet determined at a time point after a fifth predetermined time T5 elapses from a time point where primary transfer of one page of one specific color is completed, the operation of the image forming units 110 of all colors and the intermediate transfer belt 103 is stopped. (B) even in a case where the print timing of the next page is determined at the time point after T5 elapses from the time point where the primary transfer of one page of one specific color is completed, the operation of the image forming units 110 of all colors and the intermediate transfer belt 103 is stopped in a case where the exposure (the writing) of the head color is not yet started at the time point (in a case where the exposure is already started at a time point after T5 elapses, it is not necessary to stop the operation of the image forming unit 110 and the intermediate transfer belt 103, and thus, the stop is not performed).

(C) the operation of the image forming units 110 (excluding the developing unit 113) of all colors and the intermediate transfer belt 103 is restarted according to the print timing of the next page, before a sixth predetermined time T6 from the timing at which the exposure (the writing) of the head color is started. (D) in a case where a time until the timing at which exposure of the head color is started is shorter than or equal to T6 at the time point where the print timing of the next page is determined, the operation of the image forming units 110 (excluding the developing unit 113) of all colors and the intermediate transfer belt 103 is immediately restarted.

Both of (A) and (B) described above are also capable of being considered as a standard that in a case where there is no particular problem at the time point after T5 elapses from the time point where the primary transfer of one page is completed the operation of the image forming units 110 of all colors and the intermediate transfer belt 103 is stopped.

The fifth predetermined time T5 is a time from the completion of the primary transfer of an image of one specific color until secondary transfer of the transferred image is completed. In a case where the intermediate transfer belt 103 is stopped before the secondary transfer is completed, the image on the intermediate transfer belt 103 remains without being secondarily transferred, and thus, it is not possible to perform an image forming process with respect to the image which has been primarily transferred. Therefore, whether the intermediate transfer belt 103 is stopped or not is determined on the basis of the situation of the time point where the secondary transfer is completed. The same standard is not necessarily required for the image forming unit 110, but in this embodiment, in order to simplify the control, the operation of units other than the developing unit 113 is stopped and restarted according to the same standard as that of the intermediate transfer belt 103.

The sixth predetermined time T6 is an expected value of a start-up time required from an operation restart instruction of the image forming unit 110 and the intermediate transfer belt 103 until an image forming operation is usually performed by each of the units. However, as described above, after the operation of the intermediate transfer belt 103 is restarted, it is difficult to expect the time required until the image forming operation is usually performed by resolving the meandering. However, as known from the description of (C) and (D), the operation of the image forming unit 110 and the intermediate transfer belt 103 is quickly restarted as T6 increases, and thus, a time shortens where the image forming unit 110 and the intermediate transfer belt 103 can be stopped. In a case where T6 decreases, the start-up of the intermediate transfer belt 103 delays the exposure start timing not in accordance with the exposure start timing set in advance, and thus, the throughput of the image formation decreases.

In consideration of such circumstances, the value of T6 may be suitably set. The user may arbitrary set the value of T6. For example, in a case where the stop time is planned to be maximally ensured even in the case of having an influence on the throughput, the value of T6 may be set to the lower limit value of the start-up time. It is also considered that the value of T6 is set to the same value as T1 described above required for the start-up of the developing unit 113.

In addition to the above description, in a case where the image forming apparatus 101 of the second embodiment stops the operation of the image forming unit 110 and the intermediate transfer belt 103, the operation of the developing unit 113 of the head color is generally restarted on the basis of the following standards (E) to (F) instead of (3) to (5) described in the first embodiment (the function of the second controller is invalidated).

(E) the operation of the developing unit 113 of the head color is restarted at a time point where the meandering of the intermediate transfer belt 103 is resolved after the operation of the intermediate transfer belt 103 is restarted. In a case where the exposure start timing of the head color is within T1 from a time point where the operation is restarted, the print timing of the next page is adjusted to be delayed such that the exposure start timing of the head color is after T1 from the time point where the operation is restarted. (F) in a case where the meandering of the intermediate transfer belt 103 is not resolved within a seventh predetermined time T7 after the operation of the intermediate transfer belt 103 is restarted, the operation of the developing unit 113 of the head color is restarted at a time point where T7 elapses. In a case where longer than or equal to T1 elapses from the restart of the operation of the developing unit 113 at the time point where the meandering is resolved, the print of the next page is immediately started, and in a case where the time does not elapse, the print timing of the next page is adjusted to be delayed such that the exposure start timing of the head color is after T1 elapses from the restart of the operation of the developing unit.

In conclusion, in (E), in a case where the operation of the image forming unit 110 and the intermediate transfer belt 103 is stopped, the operation of the developing unit 113 is restarted at a time point where the resolution of the meandering which is a predetermined event capable of being a standard for expecting a restart completion time, is detected, during the restart of the operation. In (F), in a case where the completion of the restart is not expected at the time point where T7 elapses from the restart of the operation, the operation of the developing unit 113 is restarted first. The start-up time of T1 is required for restarting the operation of the developing unit 113, and thus, according to (E), the exposure of the next page is started further after T1 from the resolution of the meandering, but according to the control of (F), in a case where a time takes for resolving the meandering, it is possible to start the exposure of the next page without waiting for T1 after the meandering is resolved.

However, in a case where T7 is excessively long, there are few cases where an effect of reducing a waiting time after the resolution of the meandering can be exhibited, and in a case where T7 is excessively short, the developing unit 113 is operated even during the resolution of the meandering, and thus, the developer is wastefully consumed. In consideration of such circumstances, the value of T7 may be suitably set. The user may arbitrary set the value of T7.

Even in both of (E) and (F), the print timing of the next page is set to timing at which the meandering of the intermediate transfer belt 103 is resolved, and the restart of the operation of the image forming unit 110 (including the developing unit 113) of at least the head color is completed.

In (E) and (F) described above, in a case where the operation of the image forming unit 110 and the intermediate transfer belt 103 is stopped, the control of restarting the operation of the developing unit 113 using T2, described in the first embodiment, is not performed. This is because in a case where the entire image forming unit 110 is stopped, it is not necessary to supply the developer to the photoconductor drum 114, and thus, there is no problem in stopping the developing unit 113 for a long period of time.

In the image forming apparatus 101 of the second embodiment, the restart of the operation of the developing unit 113 other than the head color in a case where the operation of the image forming unit 110 and the intermediate transfer belt 103 is stopped is restarted according to (3) and (4) described in the first embodiment, and here, it is not necessary to consider (5).

Figure 15:
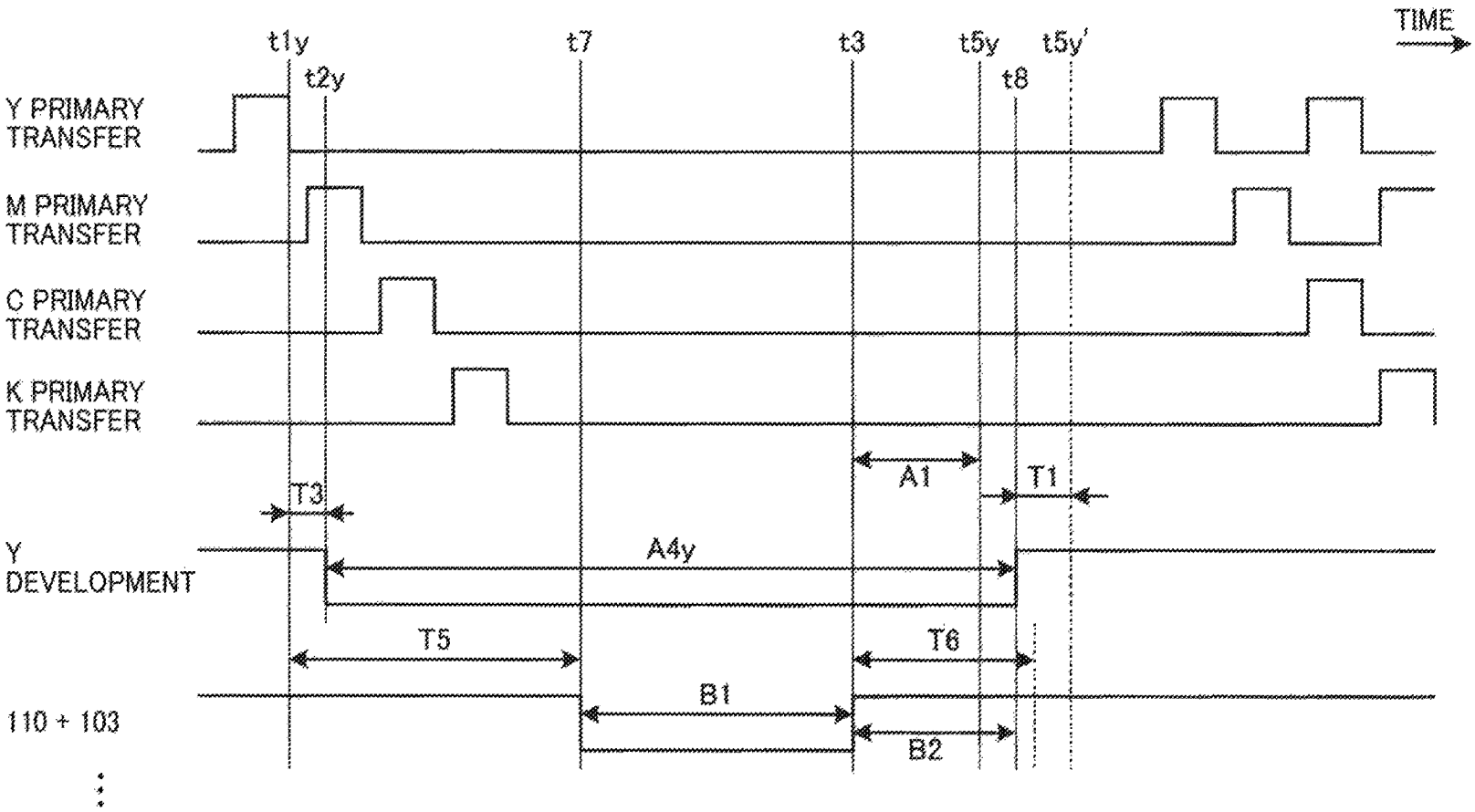
FIG. 15 is a diagram illustrating an example timing at which the image forming apparatus of the second embodiment stops and restarts operations of the developing unit, an image forming unit, and an intermediate transfer belt.
Figure 16:
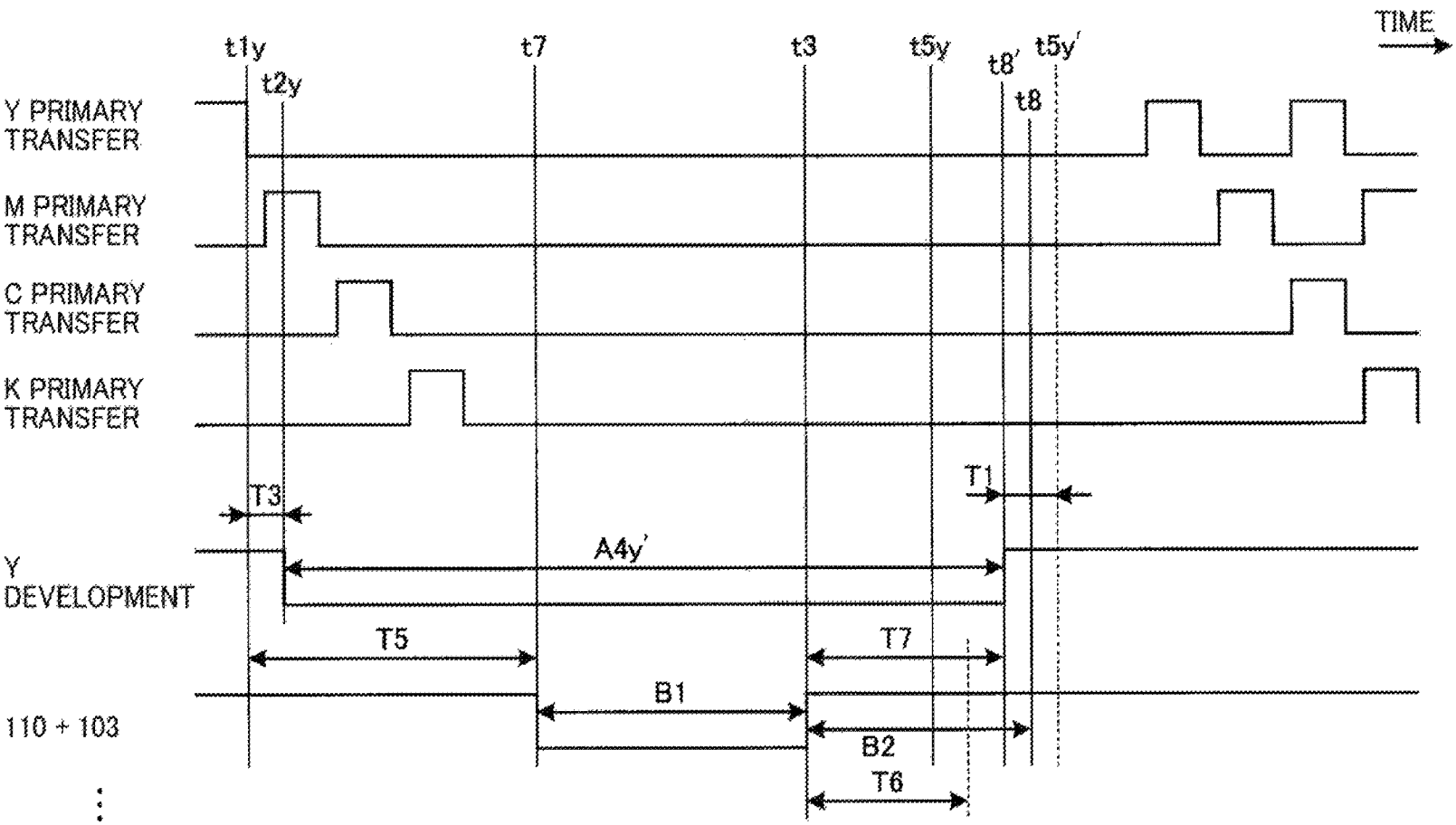
FIG. 16 is a diagram illustrating an example timing at which the image forming apparatus of the second embodiment stops and restarts operations of the developing unit, the image forming unit, and the intermediate transfer belt.
Figure 17:
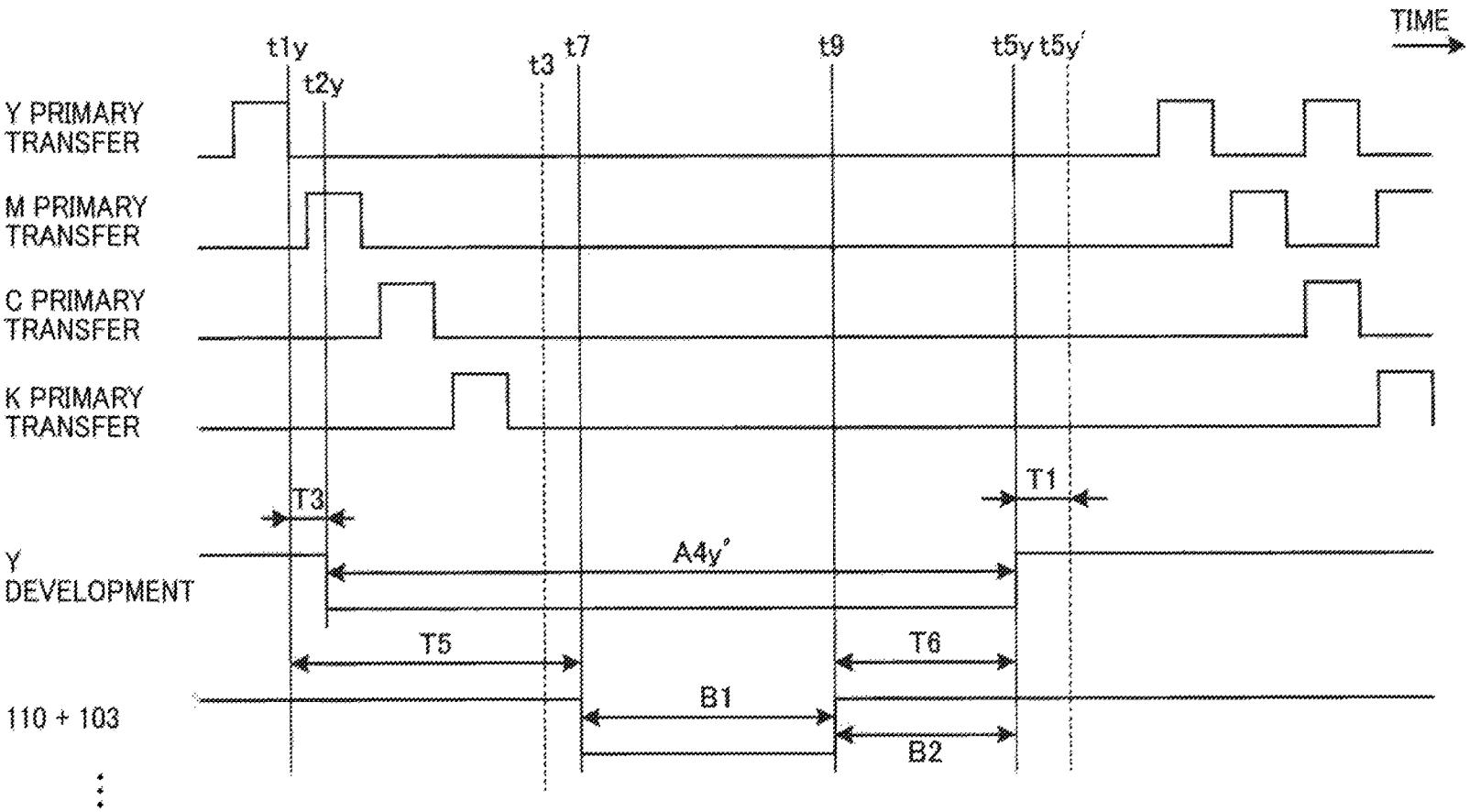
FIG. 17 is a diagram illustrating an example timing at which the image forming apparatus of the second embodiment stops and restarts operations of the developing unit, the image forming unit, and the intermediate transfer belt.

FIG. 15 to FIG. 17 illustrate an example of timing of stopping and restarting the operation of the developing unit 113, the image forming unit 110, and the intermediate transfer belt 103 according to the standards described above. Such drawings correspond to FIG. 5 and the like, and the ON/OFF timing of the image forming unit 110 and the intermediate transfer belt 103 is illustrated in a position representing "M developing" in FIG. 5. The ON/OFF timing is represented as a common waveform between the signal of the "image formation ON/OFF" corresponding to the image forming unit 110 of each color and the signal of the "belt driving ON/OFF" (See "110+113" in Figures). In both of the signals, a high level is ON, a low level is OFF, and in a range to be controlled, described by using FIG. 15 to FIG. 17, the waveforms of each of the signals are constantly the same.

FIG. 15 illustrates an example of a case where the print timing of the next page is not determined until a time point after T5 from the completion of primary transfer of a certain page, and after that, the print timing of the next page is determined for a comparatively long period of time, and a time from the determination to the start of the print is comparatively short.

In this example, the print timing of the next page is not determined at the time t1*y* where the primary transfer of Y of the first page is completed, and thus, as with the case of FIG. 6, the developing unit 113Y of Y is stopped at the time where t2*y* after T3 elapses therefrom, according to the standard (1).

The print timing of the next page is not determined even at the time t7 after T5 from the time t1*y*, and thus, the image forming units 110 of all colors and the intermediate transfer belt 103 are stopped at this time point, according to the standard (A). Here, T3+T2>T5 is obtained, the operation of the developing unit 113Y is not restarted until the time t1*y*.

After that, in a case where the print timing of the next page is determined at the time t3 according to this, the exposure start timing of each color is determined.

Here, in a case where the time from t3 until the exposure start timing t5*y* of Y, which is the head color, is A1 (<T6), operation of the image forming units 110 (excluding the developing unit 113) of all colors and the intermediate transfer belt 103 is immediately restarted according to the standard (D). Whether or not the exposure start timing of Y is delayed is not yet determined at this time point, but may be set after T6+T1 elapses from t3. At least, in a case where the meandering of the intermediate transfer belt 103 is not resolved until the time t5*y*, it is not possible to start the exposure at the t5*y* as with the original schedule, and thus, it is necessary to hold or delay the start of the exposure.

After that, the meandering of the intermediate transfer belt 103 is resolved at a time t8 after B2 (<T7) elapses from t3. In this case, the operation of the developing unit 113Y of Y is restarted at this time point, according to the standard (E). The exposure start timing Y of the next page is delayed until the time t5*y*' T1 from t8, according to the standard (E), and according to this, the exposure start timing of each of the other colors is adjusted.

The restart of the operation of the developing units 113 of the other colors is controlled according to the standards (3) and (4) described above, and in a case where the exposure start timing is adjusted, it is considered that the standard (4) is not applied, and the control is substantially performed according to the standard (3).

According to the operation described above, the print timing of the second page is slightly delayed from the initially determined timing, but the image forming units 110 of all colors and the intermediate transfer belt 103 are stopped only during a period represented by B1, and thus, the power consumption during this time can be reduced. During this time, the developing unit 113 is also stopped, and thus, an effect of reducing the consumption of the developer can be also similarly obtained as with the case of the first embodiment.

FIG. 16 illustrates an example of a case where the time required for resolving the meandering of the intermediate transfer belt 103 is shorter than in the example of FIG. 15.

This example is identical to the example of FIG. 15 until the time t3, but the time B2 required for resolving the meandering of the intermediate transfer belt 103 is longer than T7. In this case, the meandering is not yet resolved at a time t8' after T7 elapses from t3, and the operation of the developing unit 113Y of Y is restarted at this time point, according to the standard (F). However, the exposure start timing of Y of the next page is not yet determined at this time point.

After that, in a case where the meandering of the intermediate transfer belt 103 is resolved at the time t8, it is known that T1 does not yet elapse from t8' at this time point. For this reason, the exposure start timing of Y of the next page is delayed until the time t5*y*' which is after T1 from t8', according to the standard (E), and according to this, the exposure start timing of the other colors is also adjusted.

According to such adjustment, it is possible to reduce the delay on the print timing of the second page, compared to a case where the operation of the developing unit 113Y is restarted by waiting until the meandering is resolved at the time t8.

FIG. 17 illustrates an example of a case where the print timing of the next page is determined until a time point after T5 from the completion of primary transfer of a certain page, and there is a comparatively long period of time until the print of the next page is started.

Even in this example, the stop of the developing unit 113Y at the time t2$y$ is identical to that in the cases of FIG. 15 and FIG. 16.

However, the print timing of the next page is determined at the time t3 before time t7 after T5 from the time t1$y$, and it is known that the exposure start timing of Y of the next page is the time t5$y$. The image forming units 110 of all colors and the intermediate transfer belt 103 are stopped at the time point of t7, according to the standard (B).

Here, the exposure start timing is known before longer than or equal to T6 from the exposure start timing t5$y$ of Y of the next page, and thus, according to the standard (C), the operation of the image forming units 110 (excluding the developing unit 113) of all colors and the intermediate transfer belt 103 is restarted at a time t9 before T6 from t5$y$.

After that, in the example of FIG. 17, the meandering of the intermediate transfer belt 103 is resolved at the time of T6 (that is, at the time t5$y$), and the operation of the developing unit 113Y of Y is restarted at this time point, according to the standard (E). The exposure start timing of Y of the next page is delayed until the time t5$y'$ which is after T1 from t5$y$, according to the standard (E), and according to this, the exposure start timing of each of the other colors is adjusted.

According to this operation, the image forming units 110 of all colors and the intermediate transfer belt 103 are stopped only during the period represented by B1, and thus, the power consumption and the consumption of the developer during this period can be reduced. An effect according to the stop of the developing unit 113 can also be obtained approximately in the same manner as in the case of the first embodiment. The delay on the print timing rather occurs, but this is inevitable. In a case where the value of T7 is set to be shorter than T6, and for example, T7=T6−T1 is set, in the current case, the operation of the developing unit 113Y is restarted such that the restart is completed along with the resolution of the meandering of the intermediate transfer belt 103, and thus, the exposure of Y can be started at the time t5$y$ according to the original schedule. However, as described above, there is also a demerit that the value of T7 is set to a small value.

Figure 18A:
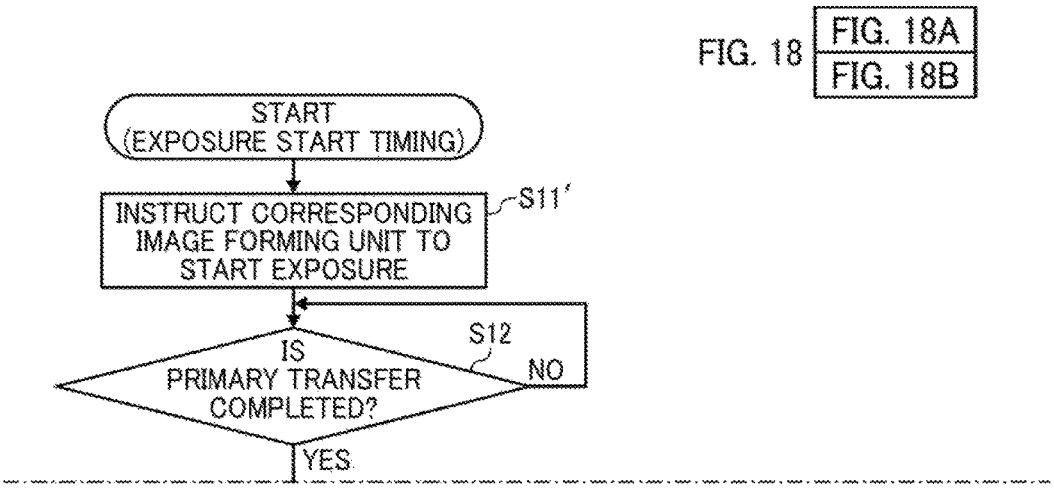
FIGS. 18A, 18B (FIG. 18), 19 and 20 illustrate flowcharts of processing for controlling the stop and the restart of the operation of the developing unit, which is executed by an engine controller of the second embodiment.
Figure 18B:
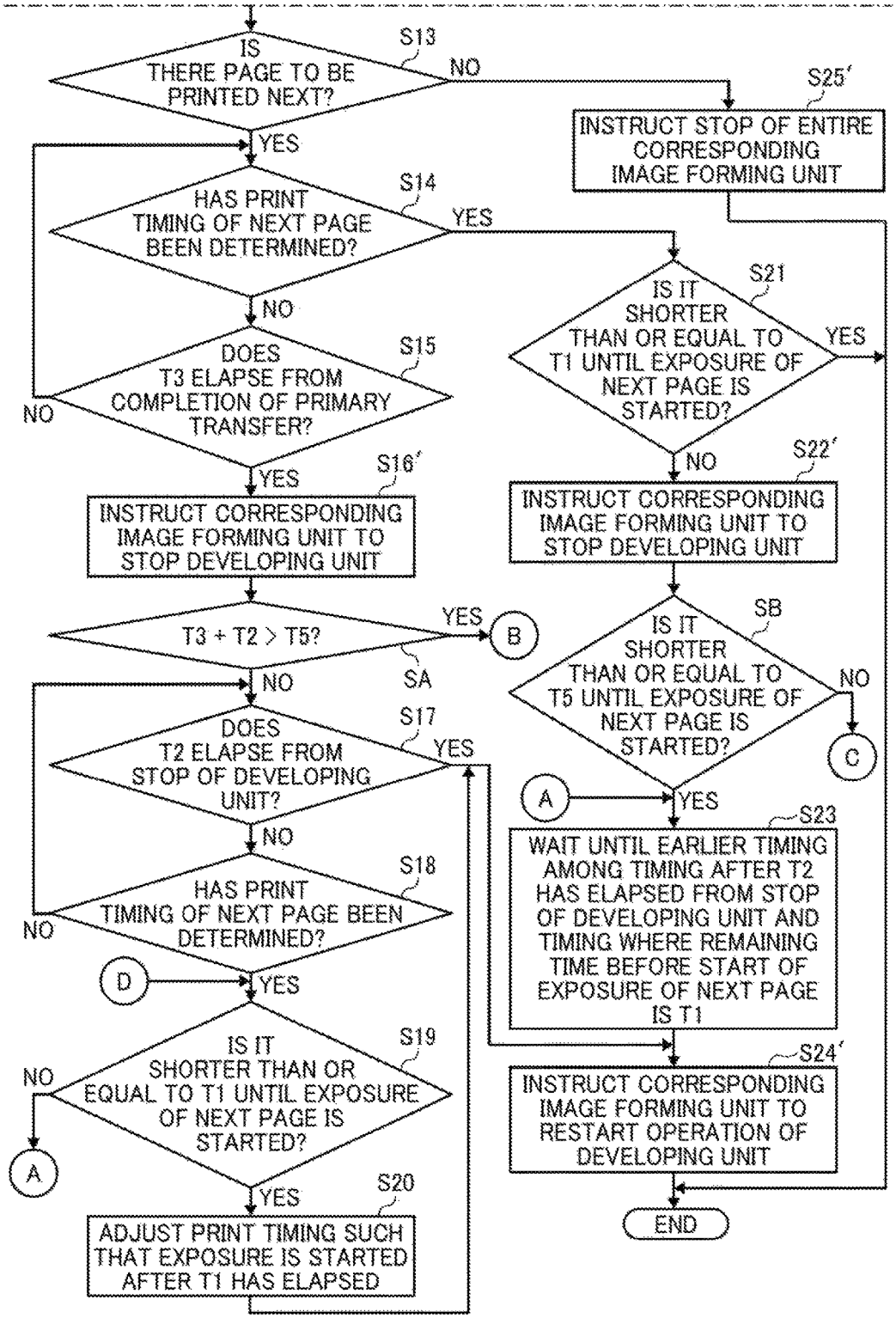
Figure 19:
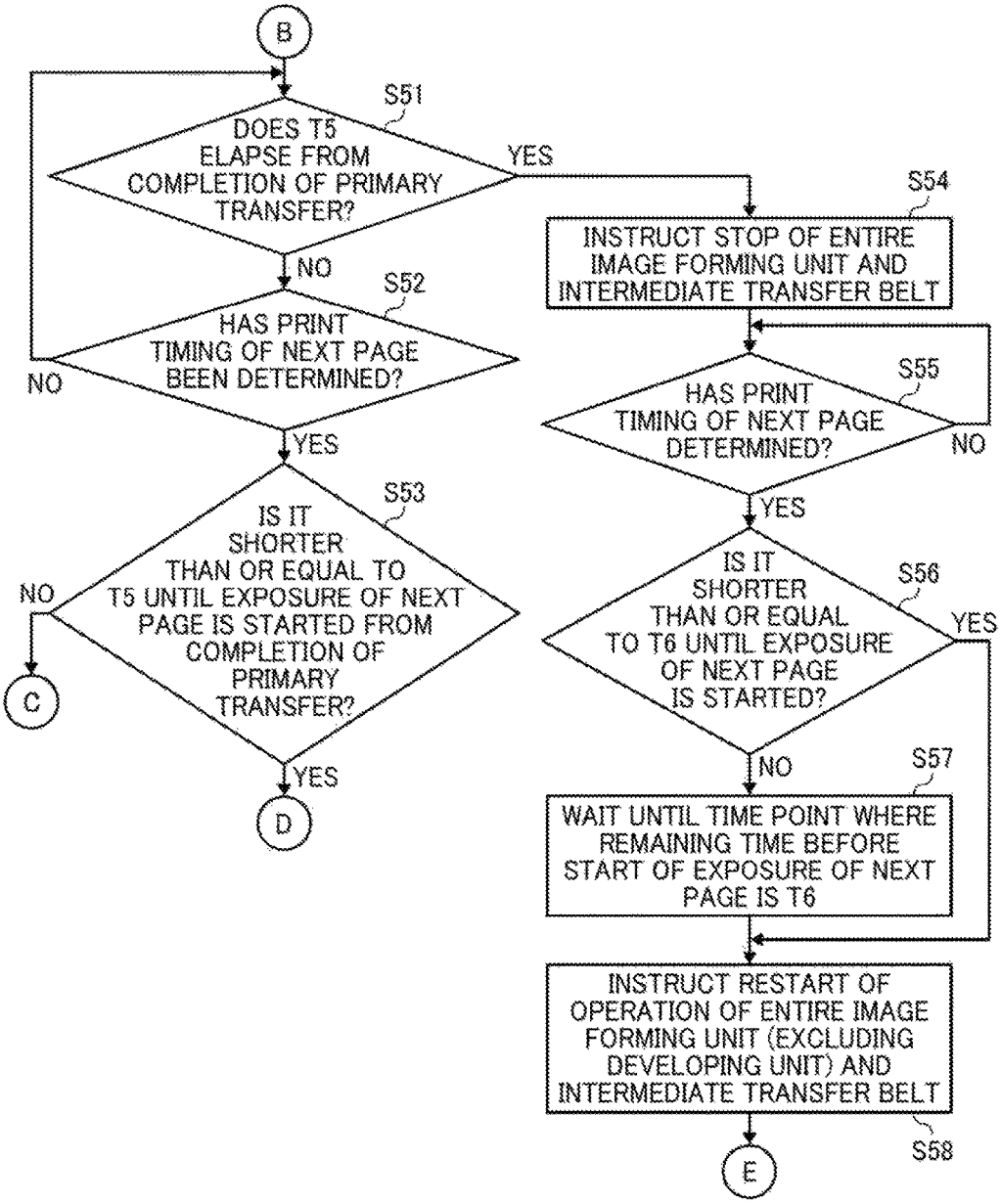
Figure 20:
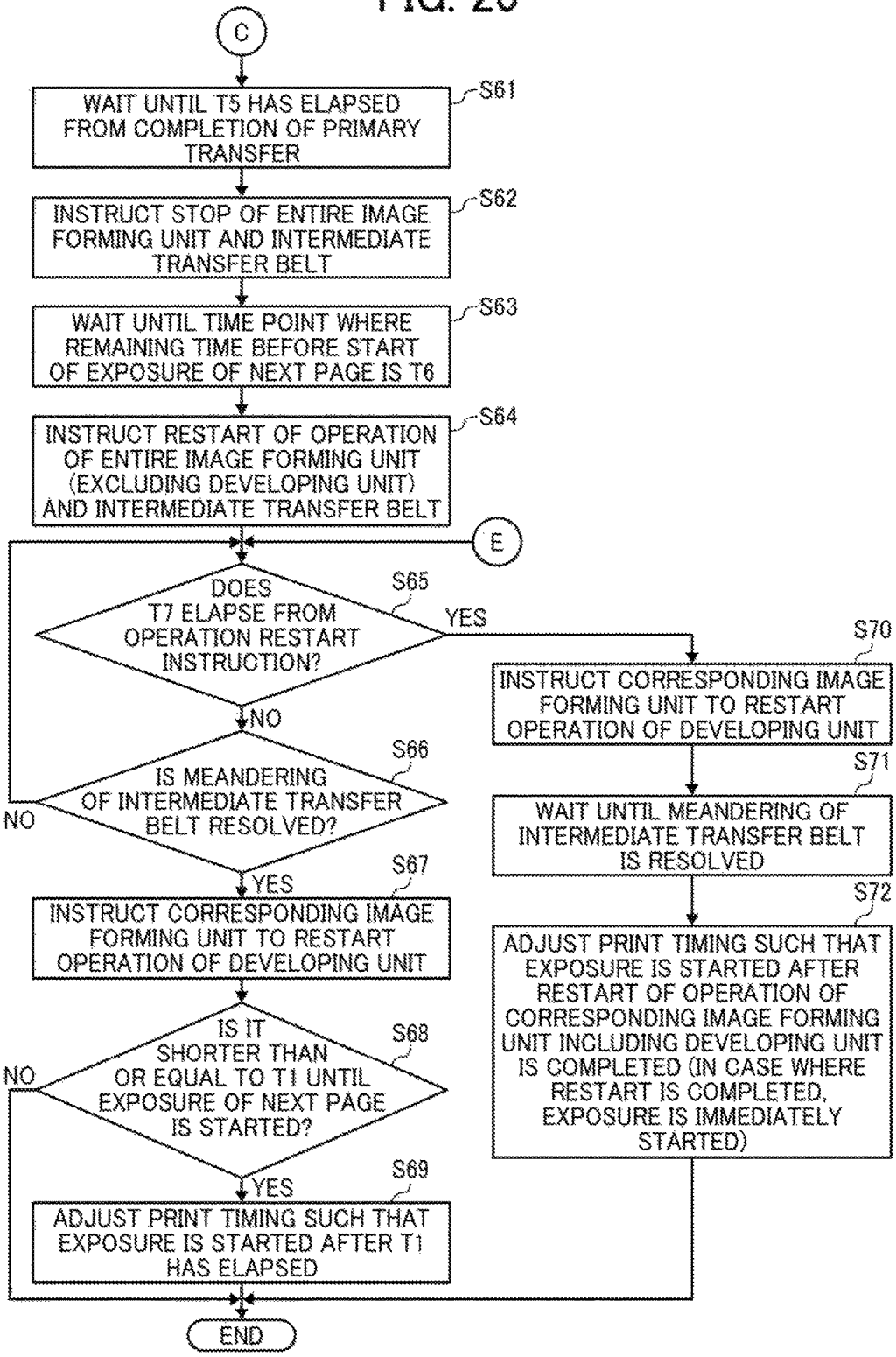

Next, FIG. 18 to FIG. 20 illustrate flowcharts of processing for controlling not only the stop and the restart of the operation of the developing unit 113 approximately in the same manner as in the case of first embodiment, but also the stop and the restart of the operation of the image forming units 110 of all colors and the intermediate transfer belt 103 according to the standards (A) to (E) described above.

The processing is performed by the processor of the engine controller 151 by executing a required program, but it will be described that the engine controller 151 executes the processing of each step. FIG. 18 to FIG. 20 illustrate processing of executing one specific color referring to the timing at the time of stopping and restarting the image forming unit 110 and the intermediate transfer belt 103. Processing which is basically the same as the processing described in the first embodiment by using FIG. 9 is executed with respect to the other colors. However, in a case where the image forming unit 110 and the intermediate transfer belt 103 are stopped, a point where the operation of the developing unit 113 is set not to be restarted based on T2 is different from FIG. 9.

In the processing illustrated in FIG. 18 to FIG. 20, a portion illustrated in FIG. 18 is identical to FIG. 9 except that Steps SA and SB are added. In order to distinguish processing of instructing the image forming unit of one specific color, such as Steps S11 and S16, from processing of instructing the entire image forming unit, such as Step S54 of FIG. 19, an instruction target is set to a "corresponding image forming unit", and according to this, "'" is applied to the step number. However, the processing is also substantially identical to the processing of the same step number of FIG. 9.

It is possible to consider that the processing of the portion illustrated in FIG. 18 is processing in a case where the image forming unit 110 and the intermediate transfer belt 103 are not stopped. That is, in a case where the determination of Step SA is No of the determination of Step SB is Yes, the image forming unit 110 and the intermediate transfer belt 103 are not stopped, and the same processing as that of FIG. 9 is continued.

In Step SA, the engine controller 151 determines whether or not T+T2 is longer than T5. Here, in the case of No, it is known that the operation of the developing unit 113 of the corresponding image forming unit is restarted before T5 from the completion of the primary transfer (the time t7 of FIG. 15), according to the standard (5). For this reason, in order to avoid constantly stopping and restarting the operation of the developing unit 113, in this case, the image forming unit 110 and the intermediate transfer belt 103 are not stopped.

In Step SB, the engine controller 151 determines whether or not the time until the exposure of the next page is started is shorter than or equal to the fifth predetermined time T5. Such determination is performed in a case where the print timing of the next page has been determined at the time point where the primary transfer is completed, and thus, in Step SB, it is determined whether or not it is the exposure start timing of the next page until a time point after T5 from the completion of the primary transfer. In the case of Yes, the image forming unit 110 and the intermediate transfer belt 103 are not stopped according to the standard (B), and thus, the process proceeds to processing of restarting the operation of the developing unit 113 after Step S23. In the case of No, the process proceeds to Step S61 of FIG. 20.

In the case of Yes in Step SA, the processing proceeds to Step S51 of FIG. 19. The engine controller 151 waits until T5 elapses from the completion of the primary transfer (Yes of S51) or the print timing of the next page is determined (Yes of S52).

In the case of Yes in Step S51, the print timing of the next page is not determined at the time point where T5 elapses from the completion of the primary transfer. For this reason, the engine controller 151 instructs the stop of the entire image forming unit 110 and the intermediate transfer belt 103 according to the standard (A) (S54).

After that, in this case, the engine controller 151 waits until the print timing of the next page is determined (S55), and in a case where the print timing of the next page is determined, it is determined whether or not the time until the exposure of the next page is started is shorter than or equal to the sixth predetermined time T6 (S56). In a case where the time is shorter than or equal to T6, the engine controller 151 immediately instructs the restart of the operation of the entire image forming unit 110 (excluding the developing unit 113) and the intermediate transfer belt 103 according to the standard (D), and in a case where the time is longer than T6, the engine controller 151 waits until the time point where the remaining time before the exposure is started is T6 according to the standard (C) (S57), and then the engine controller 151 instructs the restart of the operation of the entire image forming unit 110 (excluding the developing unit 113) and the intermediate transfer belt 103 (S58). In the image forming unit 110, the signal of the "developing ON/OFF" may be turned off while the signal of the "image formation ON/OFF" is turned on. After Step S58, the processing proceeds to Step S65 of FIG. 20.

In the case of Yes in Step S52, the print timing of the next page is determined before T5 elapses from the completion of the primary transfer. For this reason, the determination to the same effect of Step SB of FIG. 18 is performed (S53). In the case of Yes, the process proceeds to Step S19 of FIG. 18, and the following processing is performed. The reason why the proceeding target is different from the case of Yes in Step SB is that it is not yet determined whether it is shorter than or equal to T1 until the exposure of the next page is started in this case. In the case of No in Step S53, the processing proceeds to Step S61 of FIG. 20, as with the case of No in Step SB. This is because in both of a case where the print timing of the next page is determined at the time point where the primary transfer is completed and a case where the print timing of the next page is determined at the time point of Step S52, the print timing of the next page is determined until after T5 from the completion of the primary transfer.

In Step S61, the engine controller 151 waits until the time when T5 has elapsed from the completion of the primary transfer, and after that, instructs the stop of the entire image forming unit 110 and the intermediate transfer belt 103 according to the standard (B) (S62). In Step SB or S53, it has been confirmed that it is not yet the exposure start timing of the next page at this time point. After that, the engine controller 151 waits until the time point where the remaining time before the exposure is started is T6 according to the standard (C) (S63), and instructs the restart of the operation of the entire image forming unit 110 (excluding the developing unit 113) and the intermediate transfer belt 103 (S64).

Next, the engine controller 151 waits until the seventh predetermined time T7 elapses from the operation restart instruction of Step S64 or Step S58 (Yes of S65) or the meandering of the intermediate transfer belt 103 is resolved (Yes of S66). The resolution of the meandering corresponds to a predetermined event during the restart of the operation of the image forming part.

In the case of Yes in Step S66, the engine controller 151 instructs the corresponding image forming unit 110 to restart the operation of the developing unit 113 according to the standard (E) (S67). In a case where it is shorter than or equal to T1 until the exposure of the next page is started at this time point, the print timing is adjusted such that the exposure is started after T1 has elapsed (S68 and S69). Accordingly, it is possible to start the exposure of the next page at timing where the restart of the operation of the developing unit 113 is completed. It is not necessary to complete the restart of the operation in portions (other units) other than the developing unit 113 at a time point of Yes in Step S66, but the restart of the operation in portions other than the developing unit 113 is completed until after T1. In other words, an event satisfying conditions of "completion until after T1" is used as a standard of the determination in Step S66.

In the case of Yes in Step S65, the meandering of the intermediate transfer belt 103 is not resolved until the time point where T7 elapses. In this case, the engine controller 151 immediately instructs the corresponding image forming unit 110 to restart the operation of the developing unit 113 according to the standard (F) (S70). After that, the engine controller 151 waits until the meandering of the intermediate transfer belt 103 is resolved (S71). The restart of the operation of the intermediate transfer belt 103 is completed at this time point, and the time until the restart of the operation of each of the image forming units 110 is completed is known (or it is known that the restart of the operation of each of the image forming units 110 is completed in advance), and thus, the engine controller 151 adjusts the print timing of the next page such that the exposure is started after the restart of the operation of the corresponding image forming unit 110 including the developing unit 113 is completed, on the basis of this time and the execution timing of Step S70 (S72). In a case where the restart of the entire operation is completed, the exposure may be immediately started. The adjustment is performed according to the standard (F).

In Step S69 or S72 described above, a set of processing up to FIG. 20 are ended.

In the processing described above, Steps SB, S51 to S54, S61, and S62 are processing corresponding to the functions of a fourth controller. Steps S55 to S58 are processing corresponding to the functions of a fifth controller. Steps S66 and S67 are processing corresponding to the functions of a sixth controller. The fourth controller, the fifth controller, and the sixth controller are the functions to be performed by the engine controller 151.

According to the processing described above, the control described by using FIG. 15 to FIG. 17 is realized, and at least a part of the image forming device 102 including the image forming unit 110 and the intermediate transfer belt 103 is stopped during the execution of the print job, and thus, the power consumption and the consumption of the developer can be reduced. Accordingly, a decrease in the throughput of the print can be suppressed.

In the example described here, when the image forming unit 110 and the intermediate transfer belt 103 are stopped, a waiting time corresponding to T3 described in the first embodiment is not provided, but may be provided.

In the processing of FIG. 18 to FIG. 20, it is determined whether or not it is shorter than or equal to T5 until the exposure of the next page is started from the completion of the primary transfer in Step SB and Step S53. However, in a case where the time until the exposure start timing is shorter than or equal to T6 at the time point where T5 elapses from the completion of the primary transfer, it is considered that, if the operation of the image forming unit 110 and the intermediate transfer belt 103 is stopped at the time point where T5 elapses, a sufficient stopping period is not obtained (the operation is immediately restarted), and the operation cannot be restarted in accordance with the exposure start timing.

Accordingly, in consideration of this, it may be determined whether or not it is shorter than or equal to T5+T6 from the completion of the primary transfer until the exposure of the next page is started, in Step SB and Step S53. In this case, as a whole, in a case where it has been determined that it is shorter than or equal to T6 until the timing of forming the image of the next page at the time point where T5 elapses after the transfer of the image of one page is completed, processing of stopping the operation of the image forming unit 110 and the intermediate transfer belt 103 is performed.

In any one of the above-described examples, any of the predetermined timer periods T1 to T6 may be stored in any desired memory such as the RAM 143.

Comparative Example

The embodiments have been described, but in the present invention, a specific configuration of the device, a specific procedure of the operation of each unit, specific timing of stopping or restarting the operation of the developing unit, and the like are not limited to the description of each of the embodiments.

For example, in each of the embodiments described above, the timing of stopping the developing unit 113 is determined according to the standards (1) and (2), based on the time point where the primary transfer of the image of each page is completed. However, the electrostatic latent image on the photoconductor drum 114 passes through the developing unit 113, the timing of stopping the developing unit 113 can be determined based on an arbitrary time point after a time point where the developing of the image of one page is completed. However, in order to switch ON/OFF of the transfer signal, the completion of the primary transfer is timing to be managed as a part of usual print control. Accordingly, in a case where the timing of stopping the developing unit 113 is determined on the basis of this timing, there is an advantage that timing management is not unnecessarily complicated in order to determine the timing of stopping the developing unit 113.

In each of the embodiments described above, the timing of restarting the operation of the developing unit 113 is determined according to the standards (3) and (4), on the basis of the exposure start timing of the image of each page. However, in a case where the operation of the developing unit 113 is restarted until the electrostatic latent image on the photoconductor drum 114 reaches the developing unit 113, the developing itself can be performed without any problem. Accordingly, the timing of restarting the operation of the developing unit 113 can be determined based on an arbitrary time point before the time point where the electrostatic latent image reaches the developing unit 113. However, in order to switch ON/OFF of the exposure signal, the start of the exposure is timing to be managed as a part of usual print control. Accordingly, in a case where the timing of restarting the operation of the developing unit 113 is determined on the basis of this timing, there is an advantage that timing management is not unnecessarily complicated in order to determine the timing of restarting the operation of the developing unit 113.

In the second embodiment, the image forming unit 110 and the intermediate transfer belt 103 have been described as a control target of which the operation is stopped and restarted, but the control target is not limited thereto. In conjunction with this, a device or a member to be operated may be added to the control target. In contrast, it is not necessary to set both of the image forming unit 110 and the intermediate transfer belt 103 as the control target.

The image forming apparatus to which the present invention is applied, may be a device forming a monochrome image but not a color image. The present invention can also be applied to an image forming apparatus in which the intermediate transfer belt 103 is not used, and the image developed on the image bearer directly transferred onto the recording paper 130.

An embodiment of a program of the present invention is a program for realizing the function of the image forming apparatus 101 in the embodiment described above by allowing a computer to control required hardware.

Such a program may be stored in a ROM, other non-volatile storage mediums (a flash memory, an EEPROM, and the like), and the like, provided in the computer, from the beginning. However, the program can be provided by being recorded in an arbitrary non-volatile recording medium such as a memory card, a CD, a DVD, and a Blu-ray Disc. The program recorded in the recording medium is executed by being installed in the computer, and thus, each of the procedures described above can be executed.

It is also possible to download the program from an external device including a recording medium in which the program is recorded or from an external device storing the program in a storage unit, coupled to a network, and to execute the program by installing the program in the computer.

It is obvious that the configurations of each of the embodiments described above can be implemented by being arbitrarily combined unless the configurations contradict each other, and can be implemented by taking out only a part.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus, comprising:

an image forming device to form a toner image onto a recording medium by transferring the toner image directly or indirectly onto the recording medium, the image forming device including a developing unit to develop a latent image formed on an image carrier into the toner image; and a controller to control the image forming device, the controller being configured to:

determine whether a first estimated time period is greater than a first predetermined time period, the first estimated time period being a time period from a time when image formation of one page of the image completes to an estimated time when image formation of a subsequent page of the image will start;

stop operating the developing unit based on a determination indicating that the first estimated time period is greater than the first predetermined time period;

determine, after determination of a time when image formation of the subsequent page of the image starts, whether an updated first estimated time period reflecting the determined time when image formation of the subsequent page of the image starts, is equal to or less than the first predetermined time period; and start operating the developing unit based on a determination indicating that the updated first estimated time period is equal to or less than the first predetermined time period, wherein, when image formation of the subsequent page of the image is not determined after an elapsed time period from the time when image formation of one age of the image completes reaches a third predetermined time period, the controller continues to stop operating the developing unit, and the controller is further configured to measure a time period during when the developing unit stops operating, and set a value of the third predetermined time period according to the measured time period during when the developing unit stops operating.

2. The image forming apparatus of claim 1, wherein the controller is further configured to determine whether an elapsed time period from a time when the controller stops operating the developing unit reaches a second predetermined time period, and resume operation of the developing unit based on a determination indicating that the elapsed time period reaches the second predetermined time period.

3. The image forming apparatus of claim 1, wherein, when the measured time period is greater than a fourth predetermined time period, the controller sets the value of the third predetermined time period to zero, and wherein, when the measured time period is equal to or less than the fourth predetermined time period, the controller sets a value greater than zero.

4. The image forming apparatus of claim 1, wherein the image forming device includes a plurality of image forming devices for respective colors to form a color image on the recording medium, and the controller independently controls a time to stop operating the developing unit for each one of the image forming devices.

5. The image forming apparatus of claim 1, wherein the controller is further configured to:

stop the entire image forming device when an elapsed time period from the time when image formation of the one page of the image data reaches a fifth predetermined time period;

determine, after determination of a time when image formation of the subsequent page of the image starts, whether the updated first estimated time period reflecting the determined time when image formation of the subsequent page of the image starts, is equal to or less than a sixth predetermined time period; and start operating an other device of the image forming device other than the developing unit based on a determination indicating that the updated first estimated time period is equal to or less than the sixth predetermined time period.

6. The image forming apparatus of claim 5, wherein the controller is further configured to invalidate operation of stopping the developing device when operation of stopping the image forming device starts, and resume operation of the developing unit based on a detection of an event after the image forming device resumes operation.

7. The image forming apparatus of claim 1, further comprising:

a fixing device to fix the toner image formed by the image forming device on the recording medium.

8. A method of controlling an image forming apparatus, comprising:

controlling an image forming device to form a toner image onto a recording medium by transferring the toner image directly or indirectly onto the recording medium, the image forming device including a developing unit to develop a latent image formed on an image carrier into the toner image;

determining whether a first estimated time period is greater than a first predetermined time period, the first estimated time period being a time period from a time when image formation of one page of the image completes to an estimated time when image formation of a subsequent page of the image will start;

controlling a developing unit to stop operating based on a determination indicating that the first estimated time period is greater than the first predetermined time period;

determining, after determination of a time when image formation of the subsequent page of the image starts, whether an updated first estimated time period reflecting the determined time when image formation of the subsequent page of the image starts, is equal to or less than the first predetermined time period;

controlling the developing unit to start operating based on a determination indicating that the updated first estimated time period is equal to or less than the first predetermined time period;

wherein, when image formation of the subsequent page of the image is not determined after an elapsed time period from the time when image formation of one page of the image completes reaches a third predetermined time period, controlling the developing unit to continue to be stopped;

measuring a time period during when the developing unit stops operating; and setting a value of the third predetermined time period according to the measured time period during when the developing unit stops operating.

9. A non-transitory recording medium which, when executed by one or more processors, cause the processors to perform a method of controlling an image forming apparatus comprising:

controlling an image forming device to form a toner image onto a recording medium by transferring the toner image directly or indirectly onto the recording medium, the image forming device including a developing unit to develop a latent image formed on an image carrier into the toner image;

determining whether a first estimated time period is greater than a first predetermined time period, the first estimated time period being a time period from a time when image formation of one page of the image completes to an estimated time when image formation of a subsequent page of the image will start;

controlling a developing unit to stop operating based on a determination indicating that the first estimated time period is greater than the first predetermined time period;

determining, after determination of a time when image formation of the subsequent page of the image starts, whether an updated first estimated time period reflecting the determined time when image formation of the subsequent page of the image starts, is equal to or less than the first predetermined time period;

controlling the developing unit to start operating based on a determination indicating that the updated first estimated time period is equal to or less than the first predetermined time period;

wherein, when image formation of the subsequent page of the image is not determined after an elapsed time period from the time when image formation of one age of the image completes reaches a third predetermined time period, controlling the developing unit to continue to be stopped;

measuring a time period during when the developing unit stops operating; and setting a value of the third predetermined time period according to period during when the developing unit stops operating.

* * * * *